US005663548A

United States Patent [19]

Hayashi et al.

[11] Patent Number: 5,663,548

[45] Date of Patent: Sep. 2, 1997

[54] VEHICLE-CARRIED UNIT FOR AUTOMATIC TOLL-PAYING SYSTEMS AND AUTOMATIC TOLL-RECEIVING APPARATUS

[75] Inventors: Hironao Hayashi, Gifu-ken; Ken Goto, Nagoya, both of Japan

[73] Assignee: Toyota Jidosha Kabushiki Kaisha, Toyota, Japan

[21] Appl. No.: 510,678

[22] Filed: Aug. 3, 1995

[30] Foreign Application Priority Data

Aug. 5, 1994 [JP] Japan ..... 6-184946

[51] Int. Cl.[6] ..... G07B 15/02

[52] U.S. Cl. ..... 235/384; 235/375

[58] Field of Search ..... 235/384, 375; 364/401; 340/928

[56] References Cited

U.S. PATENT DOCUMENTS

| | | | |
|---|---|---|---|
| 3,958,103 | 5/1976 | Oka et al. . | |
| 3,984,660 | 10/1976 | Oka et al. . | |
| 4,977,501 | 12/1990 | Lefevre | 235/384 |
| 5,086,389 | 2/1992 | Hassett et al. | 235/384 |
| 5,310,999 | 5/1994 | Claus et al. . | |
| 5,424,727 | 6/1995 | Shieh | 235/384 |
| 5,451,758 | 9/1995 | Jesadanont | 235/384 |
| 5,485,520 | 1/1996 | Chaum et al. | 235/384 |

FOREIGN PATENT DOCUMENTS

| | | |
|---|---|---|
| 413948 | 2/1991 | European Pat. Off. . |
| 577328 | 1/1994 | European Pat. Off. . |
| 2425734 | 12/1974 | Germany . |
| 62-98482 | 5/1987 | Japan . |
| 4255090 | 9/1992 | Japan . |
| 5-12289 | 1/1993 | Japan . |
| 5-12521 | 1/1993 | Japan . |
| 5210687 | 8/1993 | Japan . |
| 5217042 | 8/1993 | Japan . |

*Primary Examiner*—Harold Pitts

*Attorney, Agent, or Firm*—Cushman, Darby & Cushman IP Group of Pillsbury Madison & Sutro LLP

[57] ABSTRACT

A vehicle-carried unit for automatic toll-paying systems carried on a vehicle for automatically paying a toll from a plurality of IC cards through communication with an on-road unit installed on a road. The toll is calculated at an exit gate in accordance with predetermined toll information (step 432), and it is judged whether or not payment is possible in accordance with balance information of a plurality of IC cards stored in a storage circuit (step 434). In the case of being capable of payment, the toll is subtracted (step 486), and a payment signal is transmitted to the on-road unit (step 488). Because balances of a plurality of IC cards are stored as described above, it becomes unnecessary to stop at a tollbooth due to shortage in balance.

28 Claims, 25 Drawing Sheets

VEHICLE-CARRIED UNIT

VEHICLE-CARRIED UNIT FOR AUTOMATIC TOLL-PAYING SYSTEMS AND AUTOMATIC TOLL-RECEIVING APPARATUS

BACKGROUND OF THE INVENTION

1. Field of the Invention

The present invention relates to a vehicle-carried unit for automatic toll-paying systems, and an automatic toll-receiving apparatus, and in particular relates to a vehicle-carried unit for automatic toll-paying systems carried on a vehicle for automatically paying a toll through communication with an on-road unit, and an automatic toll-receiving apparatus for automatically receiving a toll through communication between a vehicle-carried unit and an on-road unit on a toll road such as an expressway.

2. Description of the Prior Art

An automatic toll-paying system, which utilizes a recording medium (for example, a card) of a prepaid system, has been hitherto developed for paying charges for utilization of pay facilities, for example, for paying a toll for passage over a toll road. In such a prepaid system, a prepaid amount of money is recorded beforehand on a recording medium, and every time a toll road is utilized, a toll for passage is subtracted from the amount of money recorded on the recording medium through wireless communication at a tollbooth gate at an entrance or an exit, and a balance is recorded on the recording medium.

However, in the case of such an automatic toll-paying system, if a balance recorded on the recording medium is not enough for a necessary amount of money such as for a toll for passage, it becomes difficult to pay the toll by using the recording medium, and complicated operations become necessary such that a shortage amount must be paid in cash.

In order to solve the problem described above, Japanese Patent Laid-open No. 5-012289 discloses a technique in which incremental data is transmitted to a wireless card in accordance with an invested amount of money for use with the card. Further, Japanese Patent Laid-open No. 5-217042 discloses a technique in which the balance of a card is updated through wireless communication in accordance with a presented amount of money at a tollbooth on a traffic lane. Furthermore, Japanese Patent Laid-open No. 5-210687 discloses a technique in which a certificate of utilization record of a card is issued on the basis of user information.

Techniques relevant to the present invention include techniques described in Japanese Patent Laid-open Nos. 62-098482, 4-255090 and 5-012521.

However, the techniques described in Japanese Patent Laid-open Nos. 5-012289 and 5-217042 have a problem, wherein it is necessary to go to a predetermined place such as a tollbooth and a service area to update the balance of a card, and hence it is postulated that the place may be crowded. Even if a plurality of cards are possessed, and a necessary toll for passage can be paid by summing up balances of the cards, only one card can be accessed when the toll is paid. Consequently, the vehicle is stopped due to shortage in toll. The conventional techniques have the problem that the operation may become impossible depending on a state of a recording medium because the operation is executed by accessing the recording medium such as a card.

The technique described in Japanese Patent Laid-open No. 5-210687 has a problem when a card record cannot be read from a card. Thus, an expensive balance in the card becomes useless when the card is damaged, and no operation for reissue can be expected because the record cannot be read.

SUMMARY OF THE INVENTION

The present invention has been made taking the aforementioned facts into consideration, an object of which is to provide a vehicle-carried unit for automatic toll-paying systems which can transmit balance information when a recording medium is in any state by transmitting the balance information after reading and accumulating the balance information from the recording medium.

Another object of the present invention is to provide a vehicle-carried unit for automatic toll-paying systems which enables accumulation of balance information of a plurality of recording media, in which a toll can be paid by using accumulated balance information.

Still another object of the present invention is to provide a vehicle-carried unit for automatic toll-paying systems in which a toll can be paid by using balance information of a plurality of recording media.

Still another object of the present invention is to provide an automatic toll-receiving apparatus in which balance information can be taken out even when a recording medium is damaged.

A first embodiment of the present invention lies in a vehicle-carried unit for automatic charge-paying systems carried on a vehicle for automatically paying a charge through communication with an on-road unit installed on a road, comprising a reading and accumulating means for reading and accumulating balance information from a recording medium on which the balance information is recorded, and a control means for transmitting the balance information accumulated in the reading and accumulating means to the on-road unit to pay the charge.

A second embodiment of the present invention lies in a vehicle-carried unit for automatic toll-paying systems carried on a vehicle for automatically paying a toll through communication with an on-road unit installed on a road, comprising a reading and accumulating means for reading and accumulating balance information from a plurality of recording media on which the balance information is recorded, and a control means for controlling the payment such that the toll is paid through communication with the on-road unit in accordance with the balance information accumulated in the reading and accumulating means, and balance information after paying the toll is recorded on the recording media.

A third embodiment of the present invention lies in a vehicle-carried unit for automatic toll-paying systems carried on a vehicle for automatically paying a toll through communication with an on-road unit installed on a road, comprising a detecting means for detecting that a balance of a recording medium on which balance information is recorded is not more than a certain amount, a reading and accumulating means for reading and accumulating the balance information from the recording medium when the detecting means detects that the balance is not more than the certain amount, and a control means for paying the toll through communication with the on-road unit in accordance with the balance information accumulated in the reading and accumulating means and balance information of a recording medium in which a balance exceeds the certain amount.

A fourth embodiment of the present invention lies in a vehicle-carried unit for automatic toll-paying systems carried on a vehicle for automatically paying a toll through communication with an on-road unit installed on a road, comprising an accepting means for accepting a plurality of recording media on which balance information is recorded, and a control means for controlling the payment, such that balance information after paying the toll obtained through communication with the on-road unit is recorded on at least one of the plurality of recording media accepted by the accepting means.

A fifth embodiment of the present invention lies in an automatic toll-receiving apparatus receiving a toll automatically on the basis of the balance information through communication between, a vehicle-carried unit carried on a vehicle including a recording medium on which the balance information is recorded, and an on-road unit installed on a road, wherein any one of the vehicle-carried unit and the on-road unit includes an accumulating means for accumulating balance information after receiving the toll obtained through communication to be recorded on the recording medium, and a balance information output means for taking out the balance information accumulated in the accumulating means in accordance with a predetermined processing and recording it on a new recording medium.

According to the first embodiment of the present invention, the balance information is read and accumulated by the reading and accumulating means from the recording medium on which the balance information is recorded, and the balance information accumulated in the reading and accumulating means is transmitted by the control means to the on-road unit installed on the road to pay the charge. Thus according to the first embodiment of the present invention, the balance information of the recording medium is accumulated in the reading and accumulating means. Accordingly, the charge can be paid in accordance with the accumulated balance information which makes it possible to pay the charge regardless of the state of the recording medium.

According to the second embodiment of the present invention, the balance information is read and accumulated by the reading and accumulating means from a plurality of recording media on which the balance information is recorded, the toll is paid by the control means through communication with the on-road unit in accordance with the balance information accumulated in the reading and the accumulating means, and the balance information after paying the toll is recorded on-the recording media. Thus according to the second embodiment of the present invention, the balance information of the plurality of recording media is accumulated. Accordingly, it becomes unnecessary to stop at a tollbooth due to a balance shortage as in the case when the toll is paid by using balance information of one recording medium. An operation to immediately update balance information of the recording medium to dissolve the shortage in balance also becomes unnecessary. Alternatively, a shortage amount may be accumulated when a shortage in the cost of the toll occurs, and the shortage amount may be paid later when a new recording medium is installed (so-called deferred payment for the shortage amount). By doing so, it becomes unnecessary to stop at a tollbooth, providing a dissolving means for preventing a crowded situation.

According to the third embodiment of the present invention, when the detecting means detects that the balance of a recording medium on which the balance information is recorded is not more than a certain amount (for example, 10 dollars), the balance information is read and accumulated by the reading and accumulating means from the recording medium. The toll is paid by the control means through communication with the on-road unit in accordance with the balance information accumulated in the reading and accumulating means and the balance information of a recording medium in which the balance exceeds the certain amount. Thus according to the third embodiment of the present invention, the balance not more than the certain amount is accumulated in the reading and accumulating means. Accordingly, the balance of the recording medium can be ultimately exhausted. The toll is paid in accordance with the balance information accumulated in the reading and accumulating means and the balance information of the recording medium in which the balance exceeds the certain amount. Thus the balance is never short upon payment of the toll.

According to the fourth embodiment of the present invention, a plurality of recording media on which the balance information is recorded are accepted by the accepting means, and the balance information obtained after paying the toll unit through communication with the on-road unit is recorded by the control means on at least one of the plurality of recording media accepted in the accepting means. Thus according to the fourth embodiment of the present invention, the toll can be paid in accordance with the balance information of the plurality of recording media without providing any accumulating means. Accordingly, it becomes unnecessary to stop at a tollbooth, and it becomes unnecessary to update the recording media in the same manner as in the second embodiment of the present invention.

According to the fifth embodiment of the present invention, the balance information obtained through communication to be recorded on a recording medium is recorded by the accumulating means on any one of the on-road unit or the vehicle-carried unit, and the balance information accumulated in the accumulating means is taken out by the balance information output means in accordance with the predetermined processing, which is recorded on a new recording medium. Thus according to the fifth embodiment of the present invention, the balance information is accumulated even when the balance information cannot be recorded due to any failure in the recording medium. Accordingly, the balance information can be taken out, and a new recording medium can be issued.

DETAILED DESCRIPTION OF THE PREFERRED EMBODIMENTS

First Embodiment

In this embodiment, the present invention is applied to an automatic toll-receiving apparatus for transmitting information through radio wave communication between a vehicle-carried unit carried on a vehicle (details will be described below) and on-road units installed on the ground, such as an entrance gate and an exit gate of a toll road, distinguishing a section already travelled over by a vehicle and vehicle type, and automatically paying a toll without stopping the vehicle at the entrance gate and the exit gate.

Figure 1:
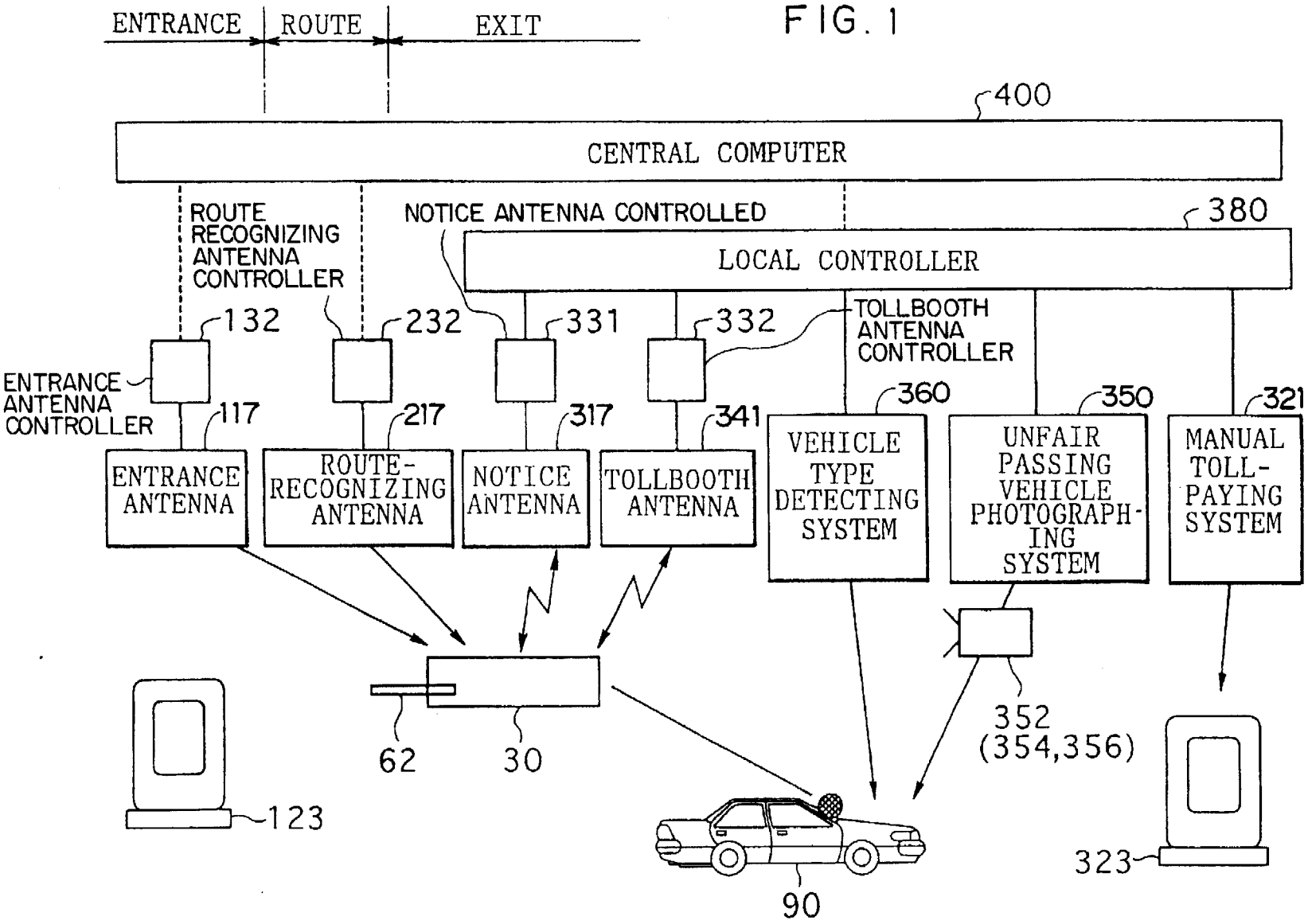
FIG. 1 is a block diagram showing an automatic toll-receiving apparatus to which the present invention can be applied.

As shown in FIG. 1, a vehicle-carried unit 30 carried on a vehicle 90 includes an IC card read/write unit 60 to which an IC card 62 with recorded balance information can be attached and detached as described below (see FIG. 5). The vehicle-carried unit 30 includes a storage circuit for previously storing fixed data such as vehicle type information comprising a number of the vehicle and an ID code, and storing information read by the IC card read/write unit 60 and so on. It reads and accumulates balance information of a plurality of installed IC cards 62 by means of the IC card read/write unit 60, and writes balance information after paying a toll into the IC card 62.

On the other hand, as facilities on the ground, there are installed on-road units for sending and receiving various information with respect to the vehicle-carried unit 30 respectively at an entrance gate 100, an intermediate route 200 just before or after a junction point, a service area, and an exit gate 300 of a toll road.

An on-road unit comprising an entrance antenna 117 composed of a flat antenna, and an entrance antenna controller 132 connected to the entrance antenna 117 is installed at the entrance gate 100. The entrance antenna controller 132 can be used to transmit entrance gate information of the toll road to the vehicle-carried unit 30 carried on the vehicle and receive signals from the vehicle carried unit 30 through the entrance antenna 117. An apparatus for issuing pass tickets 123 similar to a conventional one is installed at the entrance gate 100 for vehicles which cannot send the toll automatically and thus the toll should be paid manually. The entrance antenna controller 132 is connected to a central computer 400 for collective management of vehicles which have entered the toll road.

An on-road unit comprising a route-recognizing antenna 217 composed of a flat antenna, and a route-recognizing antenna controller 232 connected to the route-recognizing antenna 217 is installed at an intermediate route 200. The route-recognizing antenna controller 232 is used through the route-recognizing antenna 217 to transmit information indicating progress after selection of a certain route from a junction point, route pass information indicating a certain route of travel on the toll road (information from the installation points of route-recognizing antenna controllers) and so on to the vehicle-carried unit 30. The route-recognizing antenna controller 232 is connected to the central computer 400 in order to collectively manage running states of vehicles on the toll road.

In order to improve the reliability of information transmitted and received through radio waves, two types of antennas, a notice antenna 317, and a tollbooth antenna 341, comprising flat antennas are arranged at the entrance gate 300. A notice antenna controller 331 is connected to the notice antenna 317, and a tollbooth antenna controller 332 is connected to a tollbooth antenna 341. The notice antenna controller 331 and the tollbooth antenna controller 332 are connected to a local controller 380 which is connected to the central computer 400. The notice antenna 317, the tollbooth antenna 341, the notice antenna controller 331, and the tollbooth antenna controller 332 act as the on-road unit of the present invention, however, the notice antenna 317 and the notice antenna controller 331 may be omitted. A vehicle type detecting system 360 for distinguishing vehicle types by image processing or the like, an unfair passing vehicle photographing system 350 connected to a camera 352 for photographing unfair passing vehicles such as vehicles which pass without paying any toll, and a manual toll-paying system 321 for vehicles from which no toll can be received automatically are installed at the exit gate 300. By collectively controlling each of the systems by using the local controller 380, a remedy for an uncollected toll, etc. is provided, and a toll for passage, etc. is automatically received corresponding to a vehicle type and a passed section (route) on which a vehicle has run. By connecting the local controller 380 to the central computer 400, information on revisions to the toll table, and information on unfair passing vehicles are sent and received smoothly and quickly.

Next, the entrance gate, the intermediate route, and the exit gate described above will be further explained.

Figure 2:
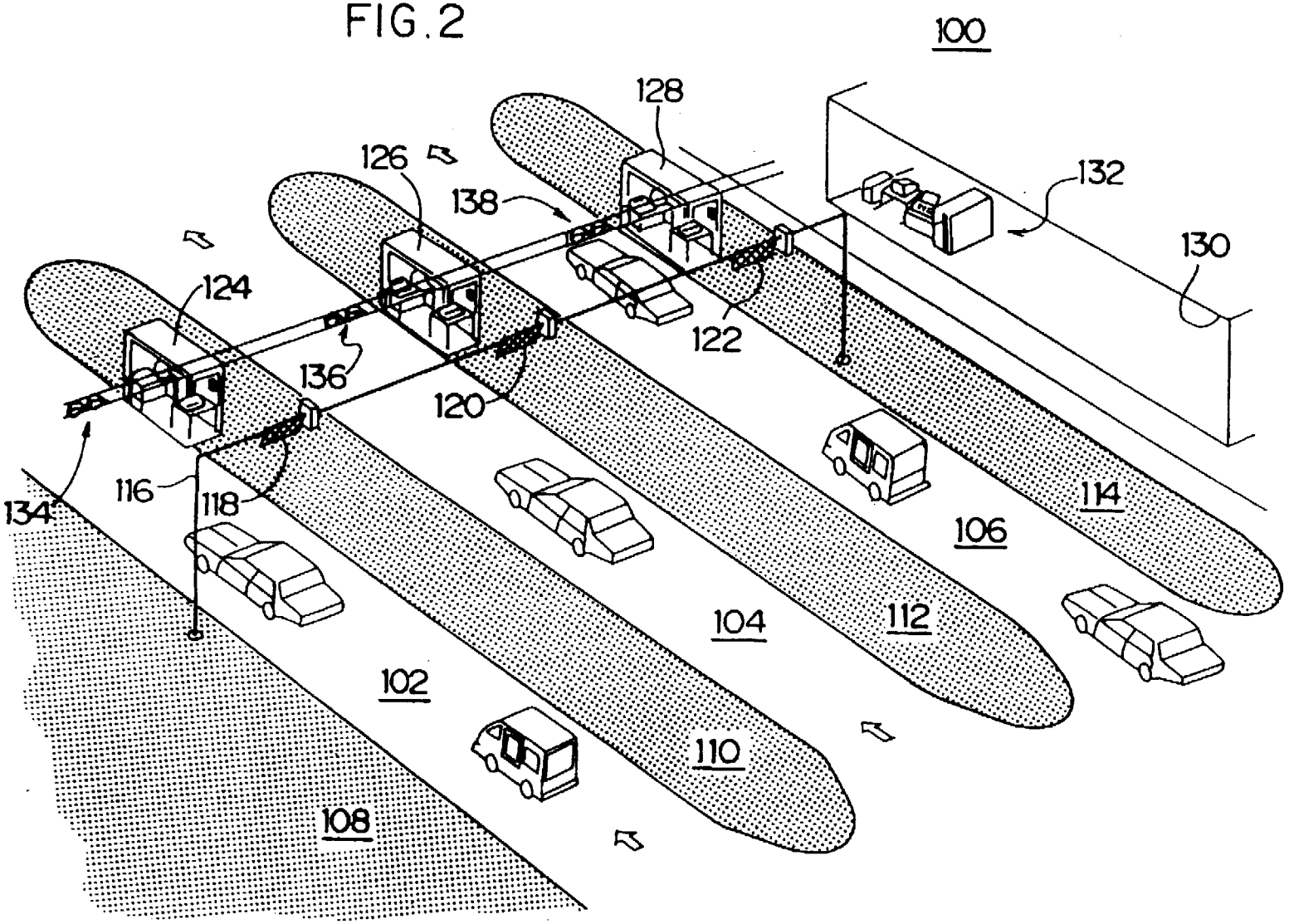
FIG. 2 is a schematic perspective view showing an entrance gate of the automatic toll-receiving apparatus in FIG. 1.

As shown in FIG. 2, the entrance gate 100 of the toll road of this embodiment has three lanes 102, 104, 106. The lane 102 is formed between a site 108 and a median strip 110, the lane 104 is formed between the median strip 110 and a median strip 112, and the lane 106 is formed between the median strip 112 and a site 114. An arch 116 is arranged to extend from the site 108 to the site 114 so as to stride over the plurality of lanes. Entrance antennas 118, 120, 122 are attached on the arch 116 so that they are located just over each of the lanes. The entrance antenna 118 sends and receives information with respect to vehicles traveling in lane 102, the entrance antenna 120 sends and receives information with respect to vehicles traveling in lane 104, and the entrance antenna 122 sends and receives information with respect vehicles traveling in lane 106.

An entrance gate control center 130 including an entrance antenna controller 132 is arranged on the site 114. The entrance antennas 118, 120, 122 are connected to the entrance antenna controller 132.

The entrance antennas 118, 120, 122 have been used in FIG. 2 as entrance antenna 117 was in FIG. 1. However, one or two entrance antennas may be used with one or two lanes, or a larger number of entrance antennas may be used.

Apparatuses for issuing pass tickets 124, 126, 128 are arranged at the entrance gate 100 corresponding to each of the lanes for paying a toll manually. The apparatuses for issuing pass tickets 124, 126, 128 are installed corresponding to lanes 102, 104, 106, respectively. The apparatuses for issuing pass tickets 124, 126, 128 are connected to the entrance gate control center 130.

Signal mechanisms 134, 136, 138 for instructing drivers as to whether they may proceed into each of the lanes are arranged corresponding to each of the lanes on a downstream side in the direction of travel of vehicles from the arch. The signal mechanisms 134, 136, 138 are connected to the entrance gate control center 130, and display either an indication when a vehicle can enter each of the lanes (for example, a blue signal) or an indication when a vehicle cannot enter it (for example, a red signal).

The entrance antenna controller 132 of the entrance gate control center 130 is connected to the central computer 400 (see FIG. 1). It is also acceptable for the entrance antenna controller 132 to not be connected to the central computer 400, and an independent control system to be provided concerning the entrance gate only.

Figure 3:
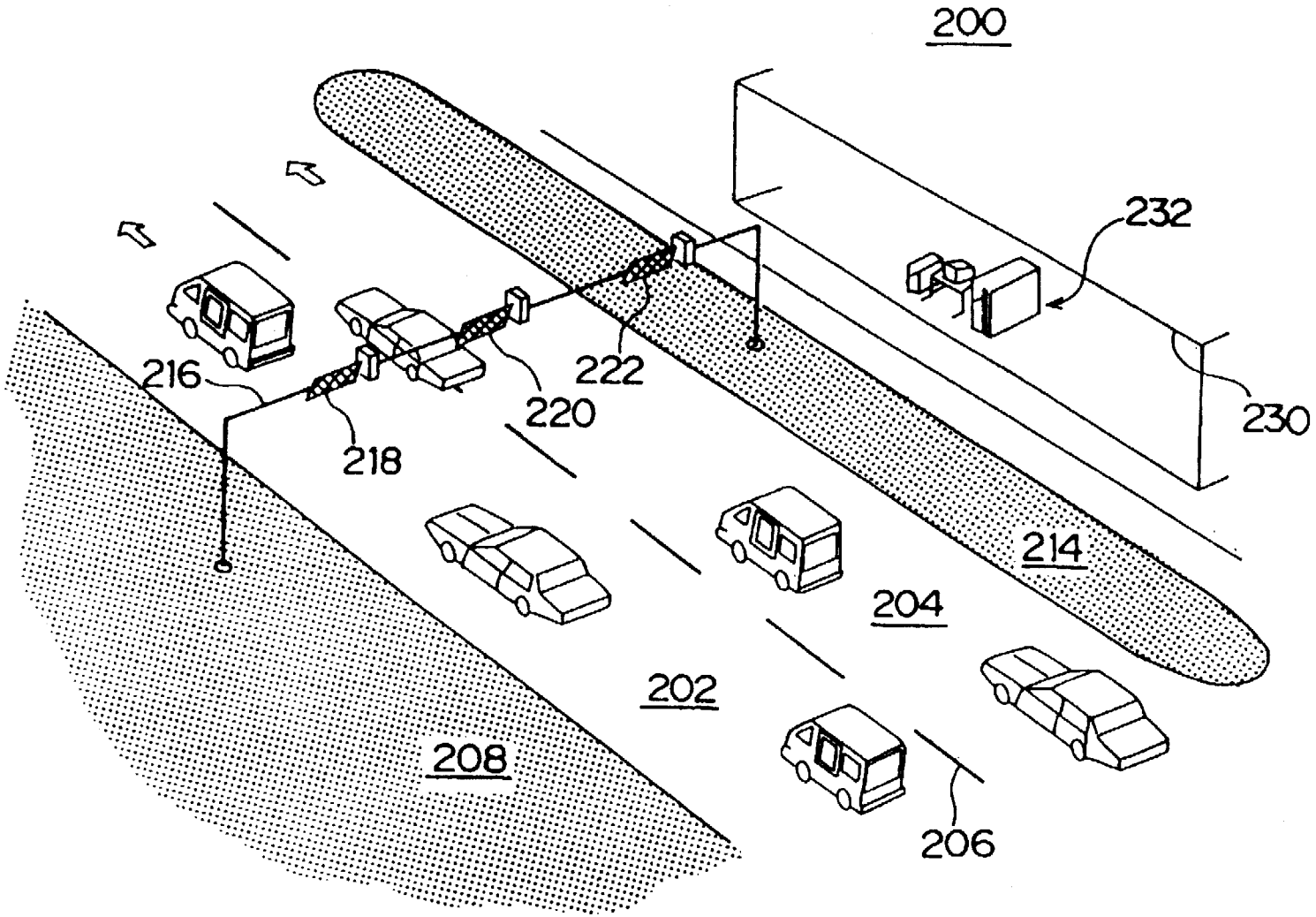
FIG. 3 is a schematic perspective view showing an intermediate route of the automatic toll-receiving apparatus in FIG. 1.

As shown in FIG. 3, the intermediate route 200 just before a junction point of the toll road is formed between sites 208 and 214 with adjoining two lanes 202, 204. An arch 216 is arranged to extend from the site 208 to the site 214 so as to stride over the lanes 202, 204. Route recognizing antennas 218, 220, 222 are attached on the arch 216. The route-recognizing antenna 218 is located over the lane 202 to send and receive information with respect to vehicles traveling in lane 202. The route-recognizing antenna 222 is located over the lane 204 to send and receive information with respect to vehicles traveling in lane 204. The route-recognizing antenna 220 for sending and receiving information with respect to vehicles striding over the lanes 202, 204 is arranged between route-recognizing antennas 218 and 222 and over center line 206 indicating a boundary between the lanes 202, 204.

A route control center 230 including a route recognizing antenna controller 232 is arranged on the site 214. The route-recognizing antennas 218, 220, 222 are connected to the route-recognizing antenna controller 232.

Figure 4:
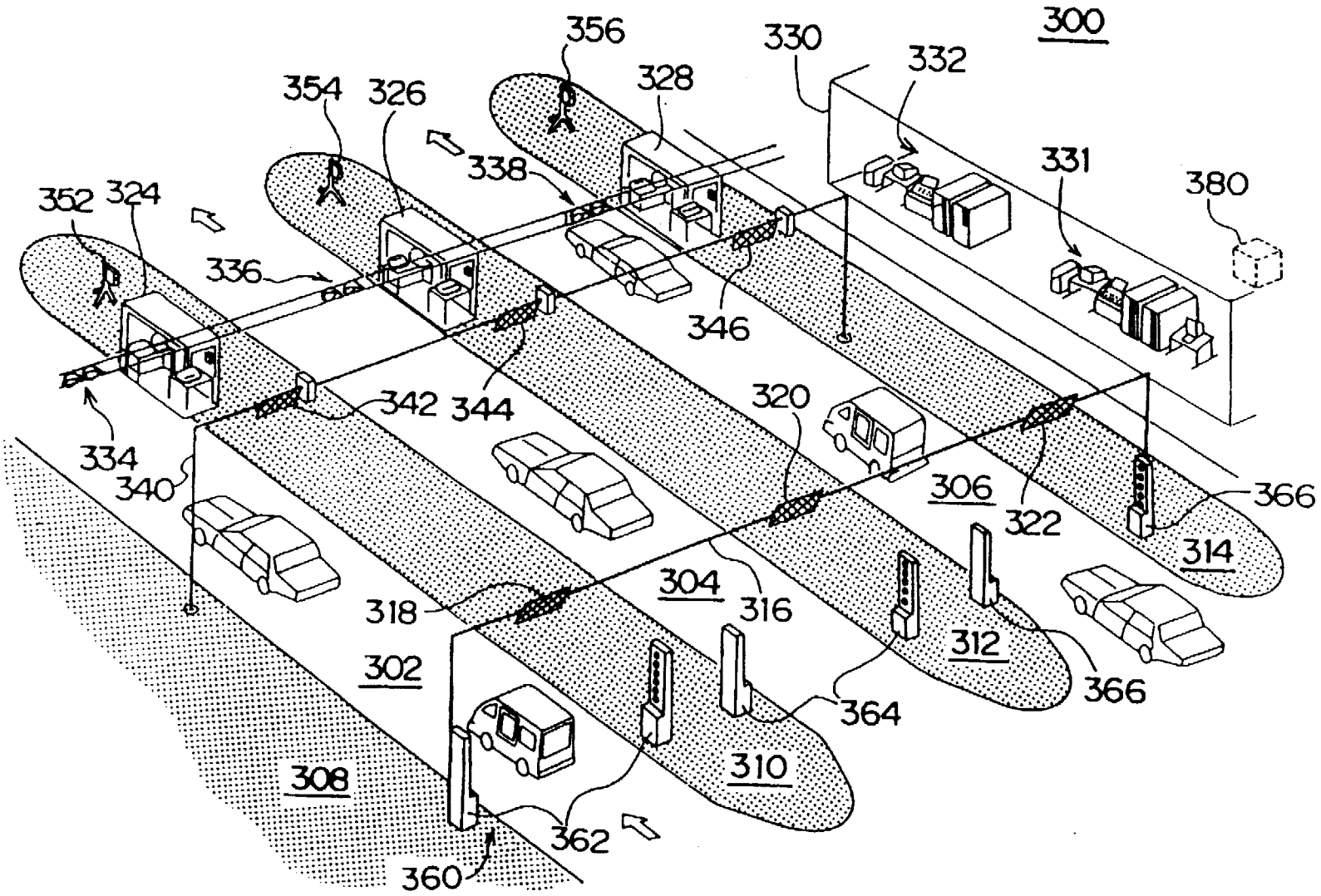
FIG. 4 is a schematic perspective view showing an exit gate of the automatic toll-receiving apparatus in FIG. 1.

As shown in FIG. 4, three lanes 302, 304, and 306 are provided at the exit gate 300 of the toll road. The lane 302 is formed between a site 308 and a median strip 310, the lane 304 is formed between the median strip 310 and a median strip 312, and the lane 306 is formed between the median strip 312 and a site 314.

An arch 316 is arranged to extend from the site 308 to the site 314 so as to stride over the plurality of lanes. Notice antennas 318, 320, 322 are attached on the arch 316. The notice antenna 318 is located over the lane 302 to send and receive information with respect to vehicles traveling in lane 302. The notice antenna 320 is located over the lane 304 to send and receive information with respect to vehicles traveling in lane 304. In the same manner, the notice antenna 322 is located over lane 306 to send and receive information with respect to vehicles traveling in lane 306.

An exit gate control center 330 is arranged on the site 314. The exit gate control center 330 includes a notice antenna controller 331, and a tollbooth antenna controller 332 described below. The notice antennas 318, 320, 322 are connected to the notice antenna controller 331.

A vehicle type detecting system 360 is arranged in the vicinity of the arch 316. The vehicle type detecting system 360 includes vehicle type detecting units 362, 364, 366 each comprising a CCD line scanner. The vehicle type detecting unit 362 is arranged on the site 308 and the median strip 310 corresponding to the lane 302 in order to distinguish vehicle types of vehicles traveling in lane 302. In the same manner, the vehicle type detecting unit 364 is arranged on the median strip 310 and the median strip 312 corresponding to the lane 304 in the vicinity of the arch 316 in order to distinguish vehicle types of vehicles traveling in lane 304, and the vehicle type detecting unit 366 is arranged on the median strip 312 and the site 314 corresponding to the lane 306 in order to distinguish vehicle types of vehicles traveling in lane 306. The vehicle type detecting system 360 comprising vehicle type detecting units connected to a local controller 380, determines the vehicle type by distinguishing silhouettes of passing vehicles by means of image processing based on images obtained by the CCD line scanner, and transmits vehicle type information to the local controller 380.

An arch 340 is arranged to extend from the site 308 to the site 314 so as to stride over the plurality of lanes on a downstream side in the direction of travel of the vehicles from the position at which the arch 316 is arranged. Tollbooth antennas 342, 344, 346 are attached on the arch 340. The tollbooth antenna 342 is located over the lane 302 to send and receive information relating to tolls with respect to vehicles traveling in lane 302. The tollbooth antenna 344 is located over the lane 304 to send and receive information with respect to vehicles traveling in lane 304. In the same manner, the tollbooth antenna 346 is located over the lane 306 to send and receive information with respect to vehicles traveling in lane 306. A tollbooth antenna controller 332 is connected to these tollbooth antennas 342, 344, 346.

Toll payment boxes 324, 326, 328 are installed at the exit gate 300 corresponding to each of the lanes for manual payment by vehicles incapable of automatically sending tolls for passage. The toll payment box 324 is arranged corresponding to the lane 302, the toll payment box 326 is arranged corresponding to the lane 304, and the toll payment box 328 is arranged corresponding to the lane 306. Microcomputers (not shown) are arranged for each of the toll payment boxes 324, 326, 328, and a manual toll payment system 321 is constructed which manages information received through manual payment by collectively managing each of the microcomputers (not shown). The manual toll payment system 321 is connected to the local controller 380 (see FIG. 1).

An unfair passing vehicle photographing system 350 for photographing unfair passing vehicles is arranged on a downstream side in the direction of travel of vehicles from the toll payment boxes (see FIG. 1). Cameras 352, 354, 356 as photographing units of the unfair passing vehicle photographing system 350 are arranged corresponding to the lanes 302, 304, 306. The unfair passing vehicle photographing system 350 is connected to the local controller 380.

Signal mechanisms 334, 336, 338 for instructing drivers as to whether or not they may proceed into each of the lanes, are arranged corresponding to each of the lanes on a downstream side in the direction of travel of vehicles from the arch 340. The signal mechanisms 334, 336, 338 are connected to the exit gate control center 330, and display either an indication when a vehicle can enter each of the lanes (for example, a blue signal) or an indication when a vehicle cannot enter it (for example, a red signal).

The exit gate control center 330 is connected to the central computer 400 (see FIG. 1). It is also acceptable for the exit gate control center 330 to not be connected to the central computer 400, and an independent control system to be provided concerning the exit gate only.

Next, the construction of the vehicle-carried unit 30 carried on a vehicle will be explained. As shown in FIG. 5, the vehicle-carried unit 30 includes a receiving antenna 32 for receiving signals transmitted from the on-road unit described below. The receiving antenna 32 is connected to a demodulating circuit 34 for demodulating waves received by the receiving antenna 32 to obtain data signals. The demodulating circuit 34 is connected through a data signal receiving circuit 44 to a signal processing circuit 46 constructed by incorporation of a microcomputer. When a toll is calculated in the vehicle-carried unit, its calculation processing is performed by the signal processing circuit 46.

Connected to the signal processing circuit 46 are a storage circuit 48 for storing data such as ID codes and vehicle type information, and a transmitting circuit 50 for transmitting data signals and so on including ID codes as response signals. In the transmitting circuit 50, an inquiry signal, which is a non-modulated conveying wave received by a transmitting and receiving antenna 52, is modulated by data signals from the signal processing circuit 46, and transmitted and returned through the transmitting and receiving antenna 52.

Connected to the signal processing circuit 46 are a display 54 constructed by LCD or CRT for displaying a toll, and a ten key 56 as an input means for inputting selection signals and so on into the signal processing circuit 46.

Also connected to the signal processing circuit 46 is an IC card read/write unit 60 to or from which an IC card 62 can be attached or detached.

The IC card read/write unit 60 is provided with one installation port (slot) for installing the IC card 62. The IC card 62 is installed to the installation port to read balance information of the IC card 62, and the read balance information is stored in the storage circuit 48. However, when the IC card 62 is disengaged, and another IC card 62 is further installed to the installation port, then its balance information is read, and the balance information is also stored in the storage circuit 48. Alternatively, with respect to the IC card read/write unit 60, a plurality of IC cards 62 may be accommodated inside, wherein a plurality of IC card read/write units each having one installation port are provided. Alternatively, an IC card read/write unit may be made movable to make it possible to read balance information of a plurality of accommodated IC cards 62. Alternatively, it is also possible to provide a plurality of installation ports while providing a plurality of IC card read/write units, or making an IC card read/write unit movable.

Arrangements having one installation port will be explained in the first to third and the seventh embodiments described below, and arrangements having a plurality of installation ports will be explained in the fourth to sixth and the seventh embodiments described below.

Connected to the IC card read/write unit 60 is an error detecting circuit 61 for detecting failures when any failure occurs in the IC card 62 upon writing balance information into the IC card 62. The error detecting circuit 61 is connected in order that a signal is sent to the signal processing circuit 46 when a failure of the IC card 62 is detected.

Electric power is always supplied to the storage circuit 48 of the vehicle-carried unit from a vehicle-carried battery, however, electric power is supplied to circuits and units other than it from the vehicle-carried battery when an ignition switch is turned on.

Next, the on-road unit for communicating with the vehicle-carried unit 30 will be explained by exemplifying an on-road unit provided at the entrance gate 100. In order to simplify the explanation, the explanation is made by using the entrance antenna 118 and the entrance antenna controller 132 in charge of sending and receiving radio waves with respect to vehicles traveling in lane 102.

Figure 6:
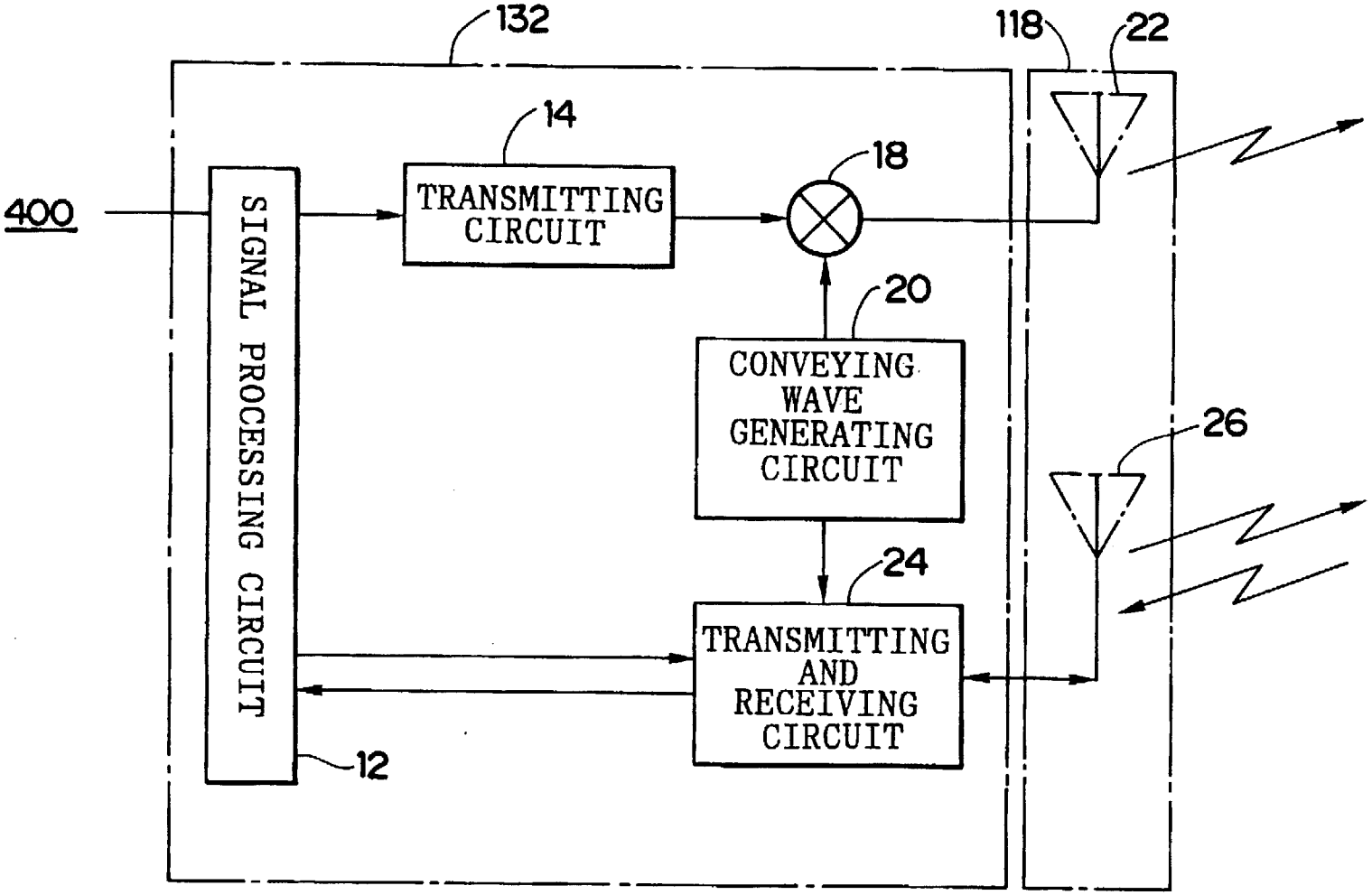
FIG. 6 is a block diagram showing an example of an on-road unit.

As shown in FIG. 6, the unit located on the ground for vehicles traveling in lane 102 comprises the entrance antenna 118 and the entrance antenna controller 132. The entrance antenna 118 includes a transmitting antenna 22 and a transmitting and receiving antenna 26. The entrance antenna controller 132 is provided with a signal processing circuit 12 which includes a microcomputer. The signal processing circuit 12 can be connected to the central computer 400. The signal processing circuit 12 is connected to a transmitting circuit 14 for transmitting data signals including instructions (communication request signals). The transmitting circuit 14 is connected to the transmitting antenna 22 through a mixer 18. Connected to the mixer 18 is a conveying wave generating circuit 20 for generating conveying waves having a predetermined frequency. The mixer 18 mixes signals inputted from the transmitting circuit 14 with conveying waves inputted from the conveying wave generating circuit 20, and modulates the conveying waves inputted from the conveying wave generating circuit 20 in accordance with the signals inputted from the transmitting circuit 14. Modulated waves are transmitted as radio waves from the transmitting antenna 22.

Figure 5:
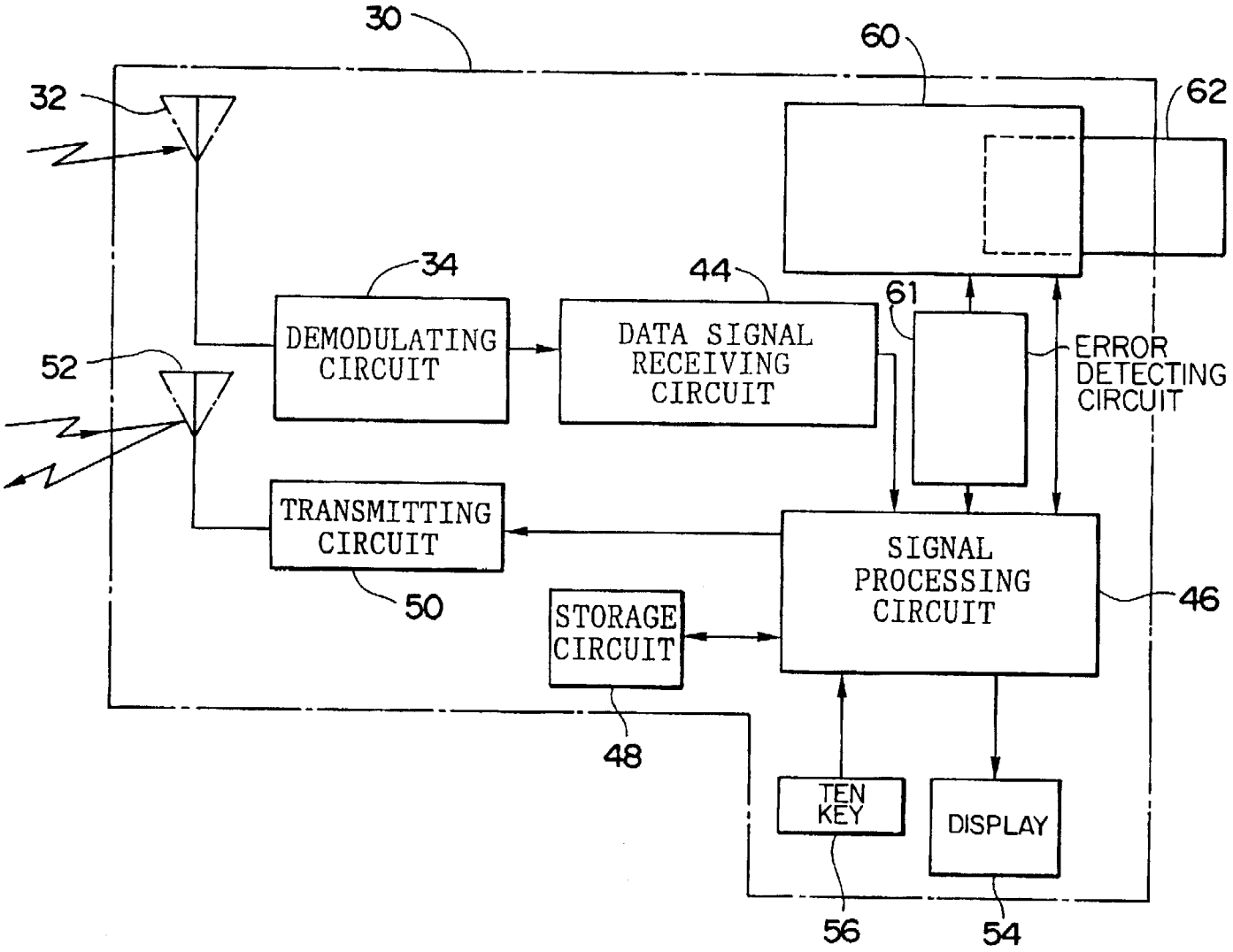
FIG. 5 is a block diagram showing a vehicle-carried unit of the present invention.

Connected to the conveying wave generating circuit 20 is a transmitting and receiving circuit 24 for taking out data signals from modulated waves returned after modulation from the vehicle-carried unit 30 shown in FIG. 5 and received by the transmitting and receiving antenna 26. The transmitting and receiving circuit 24 is connected to the signal processing circuit 12.

The other entrance antennas provided at the entrance gate 100 have the same construction as that described above, explanation of which is omitted. Each of the antennas and the antenna controllers provided at the intermediate route 200 and the exit gate 300 also has approximately the same construction as that described above, explanation of which is omitted.

Next, a processing routine of the first embodiment will be explained. In this first embodiment, a toll is calculated in the vehicle-carried unit in accordance with previously determined toll information (information regarding toll table, entrance, route and exit) and vehicle type information, the calculated toll is subtracted from cumulated balance information of a plurality of IC cards, and balance information after subtraction of the toll is written into the IC card(s). Thus the toll is paid and received.

Figure 7:
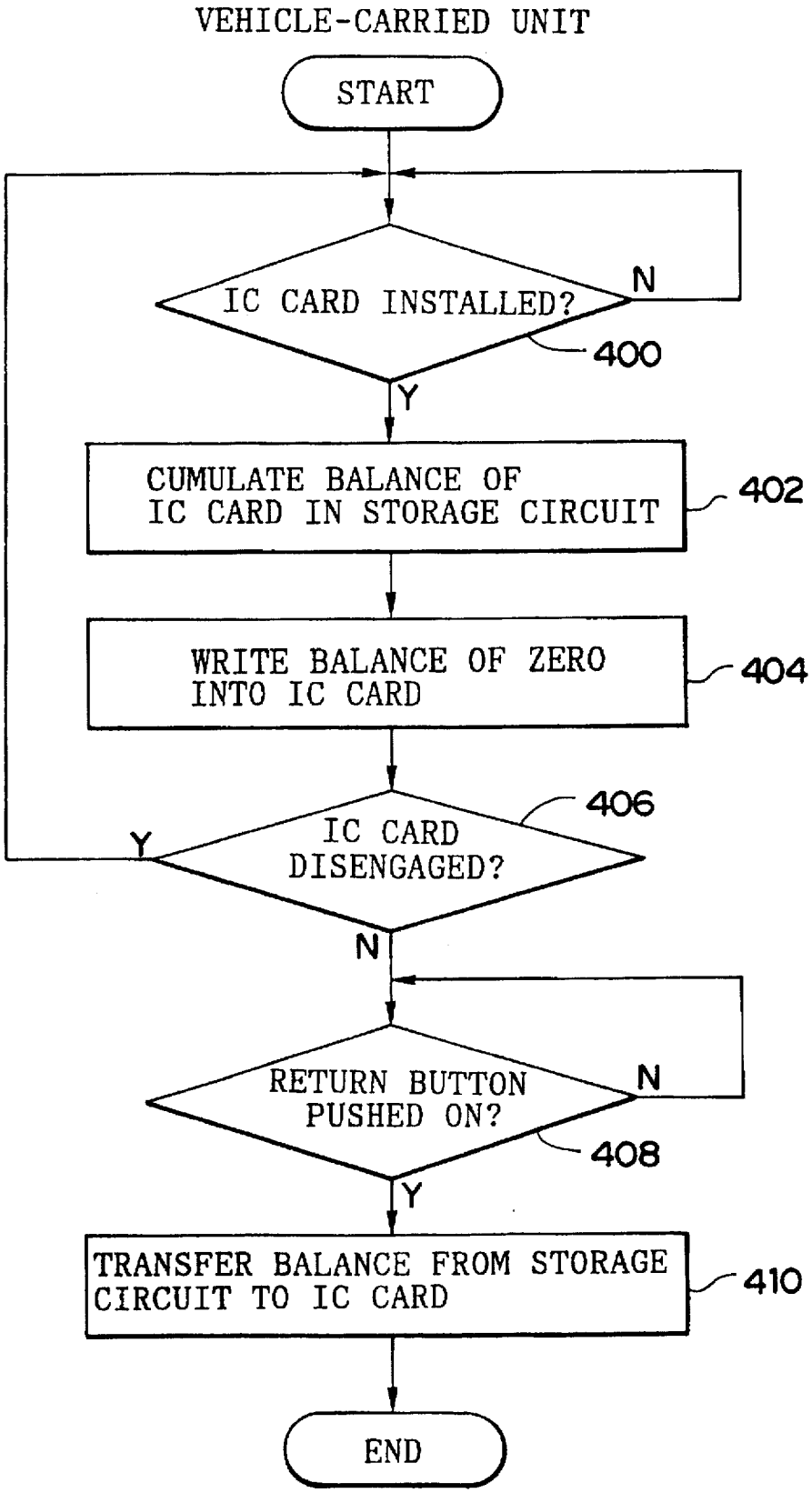
FIG. 7 is a flow chart showing accumulation processing routine for balance information of an IC card operated in a vehicle-carried unit in first and second embodiments.

FIG. 7 shows a processing routine for reading a balance of an IC card 62 installed to the IC card read/write unit 60 and storing it in the storage circuit 48.

If it is judged in step 400 that an IC card 62 is installed to the IC card read/write unit 60, all balance information of the IC card 62 is read by the IC card read/write unit 60 in accordance with a signal from the microcomputer in the signal processing circuit 46 in a step 402, and the read balance information is stored in the storage circuit 48. If there is any balance information already stored, it is added to the balance information. As a method of accumulation in the storage circuit it is also acceptable that read balance information of a plurality of IC cards 62 is respectively stored at separate positions, and a total of their balances is stored at still another position.

In step 404, a balance of zero is written by the IC card read/write unit 60 into the IC card 60 having been read. If the IC card 62 is disengaged in step 406, the routine proceeds to step 400 to give a state in which balance information of another IC card 62 can be accumulated.

In a state in which an IC card 62 remains installed in step 406, if a predetermined key of the ten key 56 (hereinafter referred to as "return button") is depressed, accumulated balance information stored in the storage circuit 48 is written into the installed IC card 62 in step 410. The reason why the accumulated balance information obtained by reading the balance is written into (returned to) the IC card 62 (in which a balance of zero has been written) is so that for example, shopping, etc. can be performed by using the IC card 62 in a service area. In such a circumstance, it is also possible to pay a charge by using the vehicle-carried unit without carrying about the IC card 62 in a service area.

An example, in which the total amount is stored in the storage circuit 48 from the IC card, has been described above. However, a certain amount may be designated for return from the storage circuit 48 to the IC card(s). A designated amount or a certain amount may be returned to each IC card one by one.

The balance information read by the IC card read/write unit 60 and the accumulated balance information are displayed on the display 54 to allow a driver to recognize the balance information. However, to prevent fellow passengers from knowing the balance information, it is also possible to suppress the display by depressing a predetermined key of the ten key 56.

Figure 9:
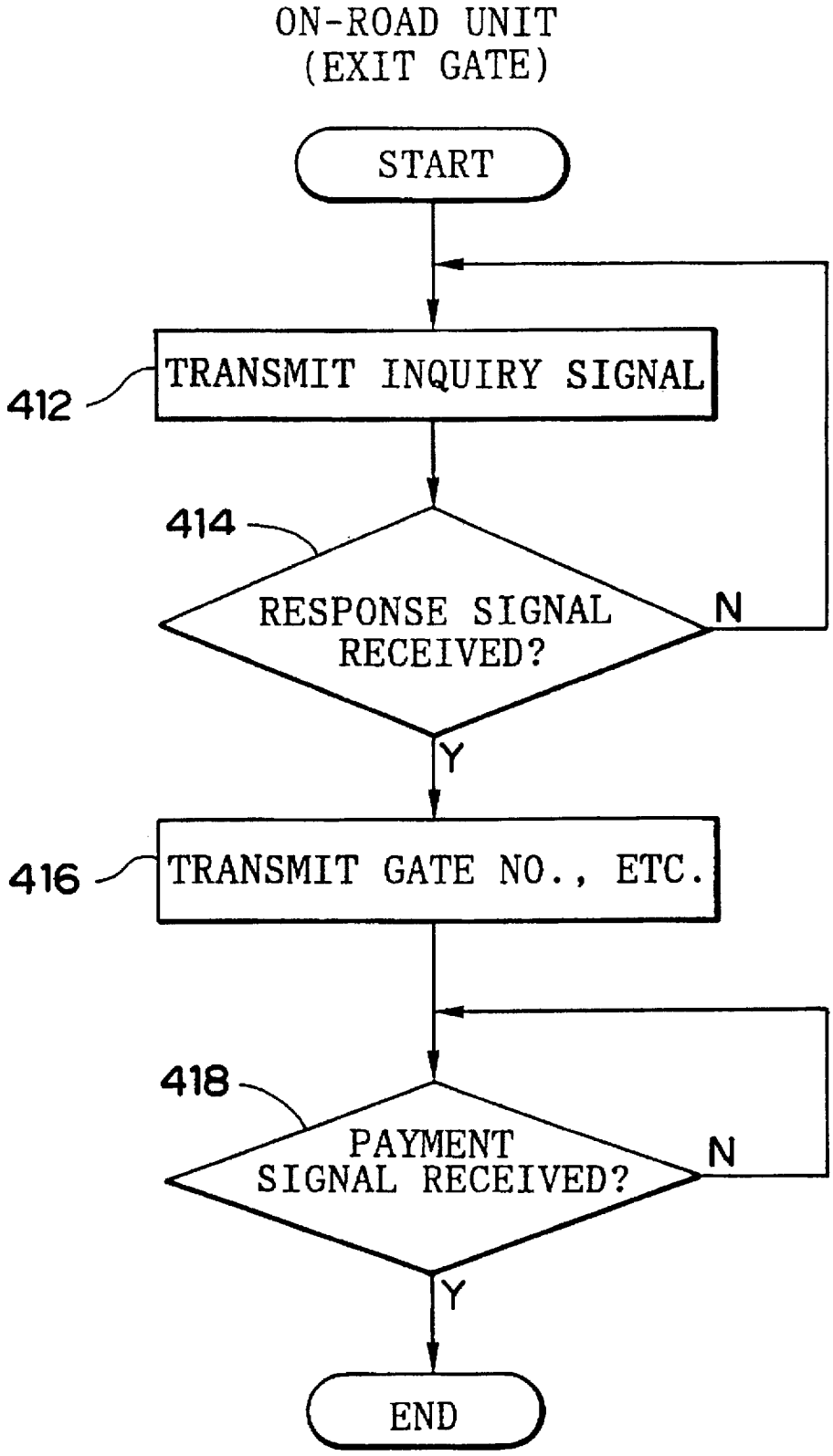
FIG. 9 is a flow chart showing a processing routine operated in an on-road unit in the first embodiment.

In the on-road unit installed at the exit gate, an inquiry signal comprising a continuous wave is transmitted in step 412 until a response signal from the vehicle-carried unit is received as shown in FIG. 9. If it is judged in step 414 that the response signal from the vehicle-carried unit is received, a signal including an exit gate number is transmitted in a step 416. A payment signal for informing of subtraction of a toll is received from the vehicle-carried unit in a step 418, and the processing routine in the on-road unit ends.

Figure 8A:
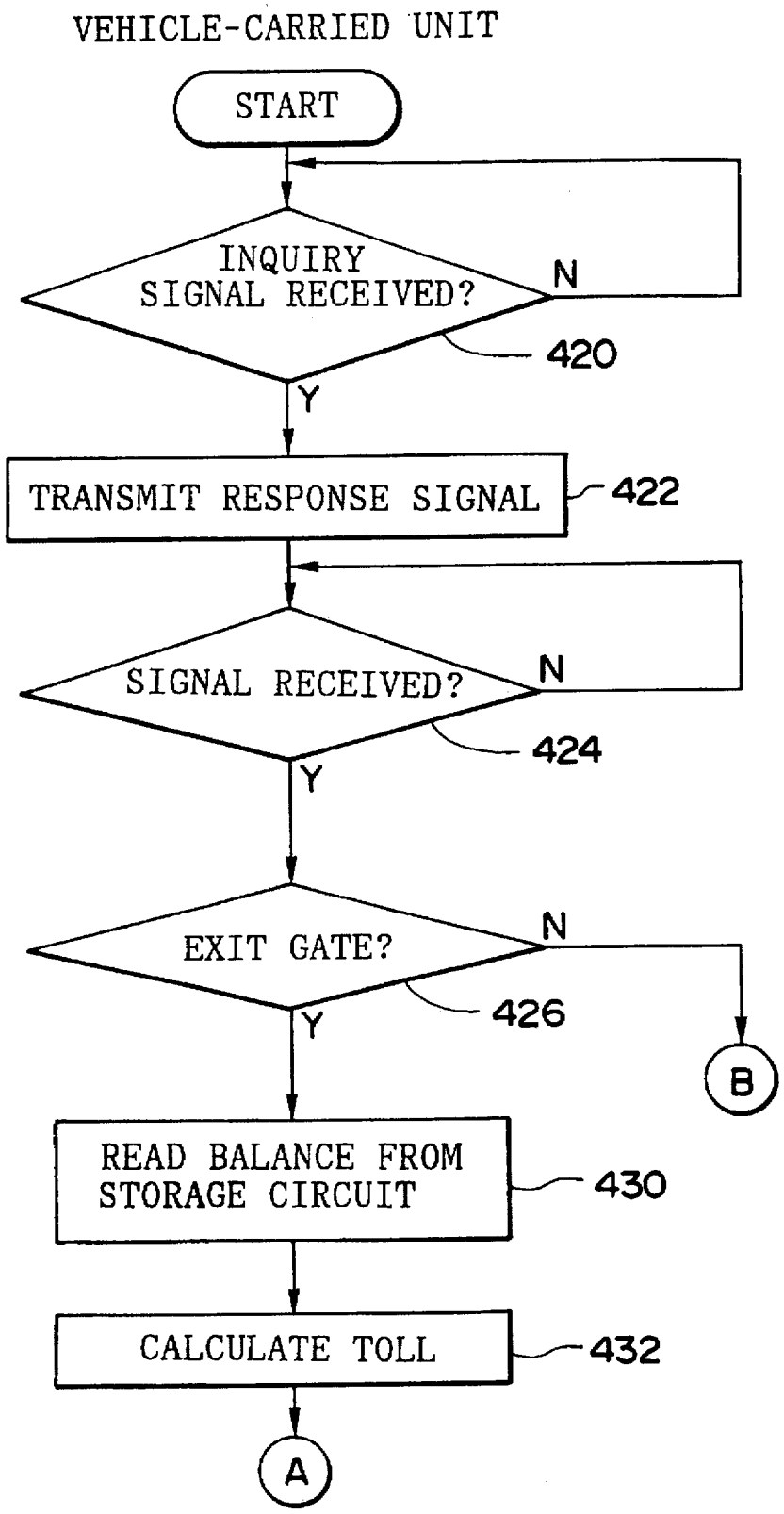
FIGS. 8A and 8B are a flow chart showing a processing routine operated in a vehicle-carried unit in the first embodiment.
Figure 8B:
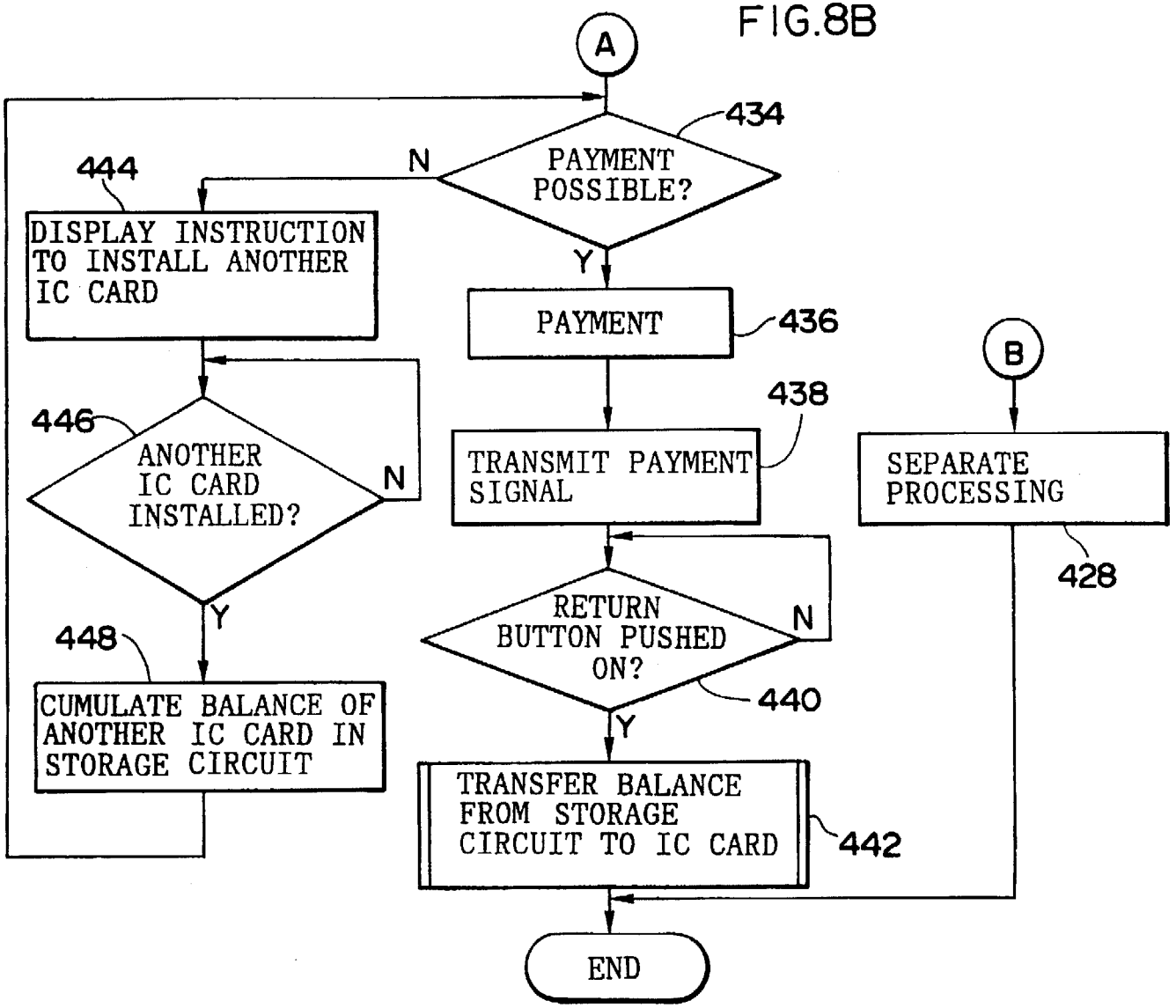

FIGS. 8A and 8B show a toll-paying processing routine in the vehicle-carried unit. If it is judged in a step 420 that an inquiry signal from the on-road unit is received, a modulated wave obtained by modulating a conveying wave with an ID code as an identification code for identifying a vehicle is transmitted to the on-road unit as a response signal by using the received inquiry signal as the conveying wave in step 422.

If it is judged in step 424 that a signal from the on-road unit is received, it is determined whether or not the vehicle is presently passing through the exit gate by determining whether or not an exit gate number is included in the received signal in step 426.

When the vehicle is not passing through the exit gate, separate processing (for example, processing for informing a driver of a range capable of being reached by using the balance in accordance with toll information and balance information stored in the storage circuit 48, etc.) is performed in a step 428. When the vehicle is passing through the exit gate, balance information accumulated in the storage circuit 48 is read in step 430.

A toll is calculated by the signal processing circuit 46 in step 432 on the basis of a toll table previously recorded in the vehicle-carried unit, entrance information received at the entrance gate and stored, route information received at a junction point, if any and stored, exit information received at the exit gate and stored, and vehicle type information stored in the vehicle-carried unit. The calculated toll is displayed on the display 54, however, it may not be displayed in the same manner as described above.

It is judged in a step 434 whether or not the balance accumulated in the storage circuit 48 is not less than the toll calculated in the step 432. When the accumulated balance is small (when payment is not possible), the routine proceeds to step 444. When the accumulated balance is not less than the toll (when payment is possible), the toll is subtracted from the balance amount cumulated in the storage circuit 48 in step 436, and a payment signal is transmitted in a step 438 to inform the on-road unit of the subtraction.

If the return button is depressed in a step 440 balance information after paying the toll stored in the storage circuit 48 is written into an IC card 62 by the IC card read/write unit 60 in step 442. The written balance information is displayed on the display 54, however, it may not be displayed. Thus the processing routine for when payment is possible ends.

When payment is not possible in step 434, an indication is given on the display 54 in step 444 such that another IC card 62 should be installed. However, it is desirable to attract the driver's attention by also producing a sound. If another IC card is newly installed in a step 446, its balance information is accumulated in the storage circuit 48 in step 448, and it is further judged in step 434 whether or not payment can be made. Therefore, the processing routine comprising the steps 444–448 is repeated until payment can be made.

When payment is not possible, the amount of shortage may be stored in storage circuit 48 to be received later, or the vehicle may be introduced to a gate for payment in cash.

In this embodiment as described above, balance information of a plurality of IC cards can be stored in the storage circuit upon payment of a toll. As a result, it is unnecessary to stop at a tollbooth due to a balance shortage. This is different from the case in which the toll is paid by using the balance information of one IC card. An operation to immediately update the balance information of an IC card in order to dissolve the balance shortage is unnecessary.

An example, in which the vehicle type information is stored in the storage circuit 48 of the vehicle-carried unit, has been explained in this embodiment. However, the vehicle type may be detected by the vehicle type detecting system 360, and the vehicle type information may be transmitted from the vehicle type detecting system 360 to the vehicle-carried unit.

A predetermined key of the ten key 56 has been used as the return button in this embodiment. However, an independent return button may be provided separately from the ten key 56.

Second Embodiment

Figure 10A:
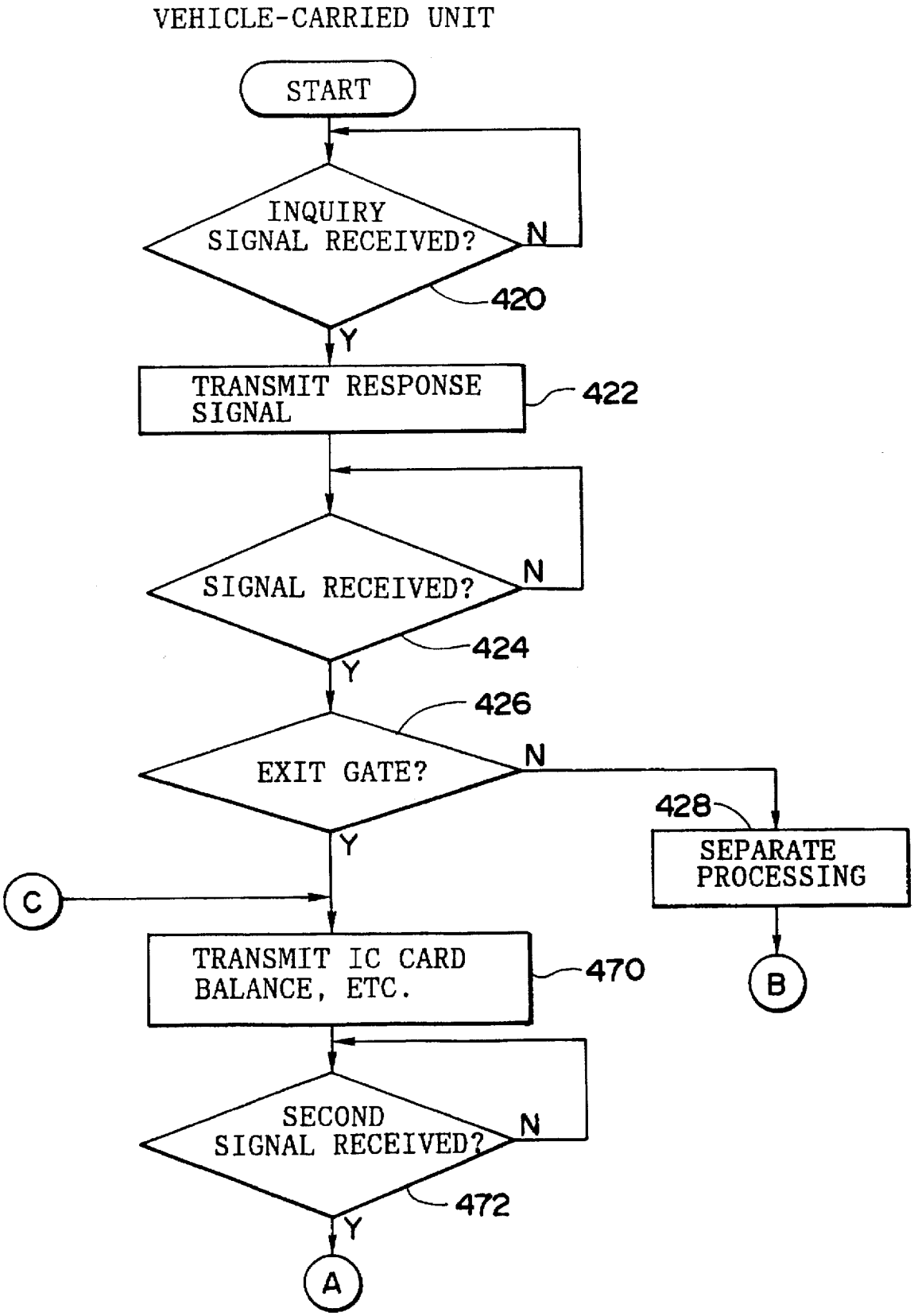
FIGS. 10A and 10B are a flow chart showing a processing routine operated in a vehicle-carried unit in the second embodiment.
Figure 10B:
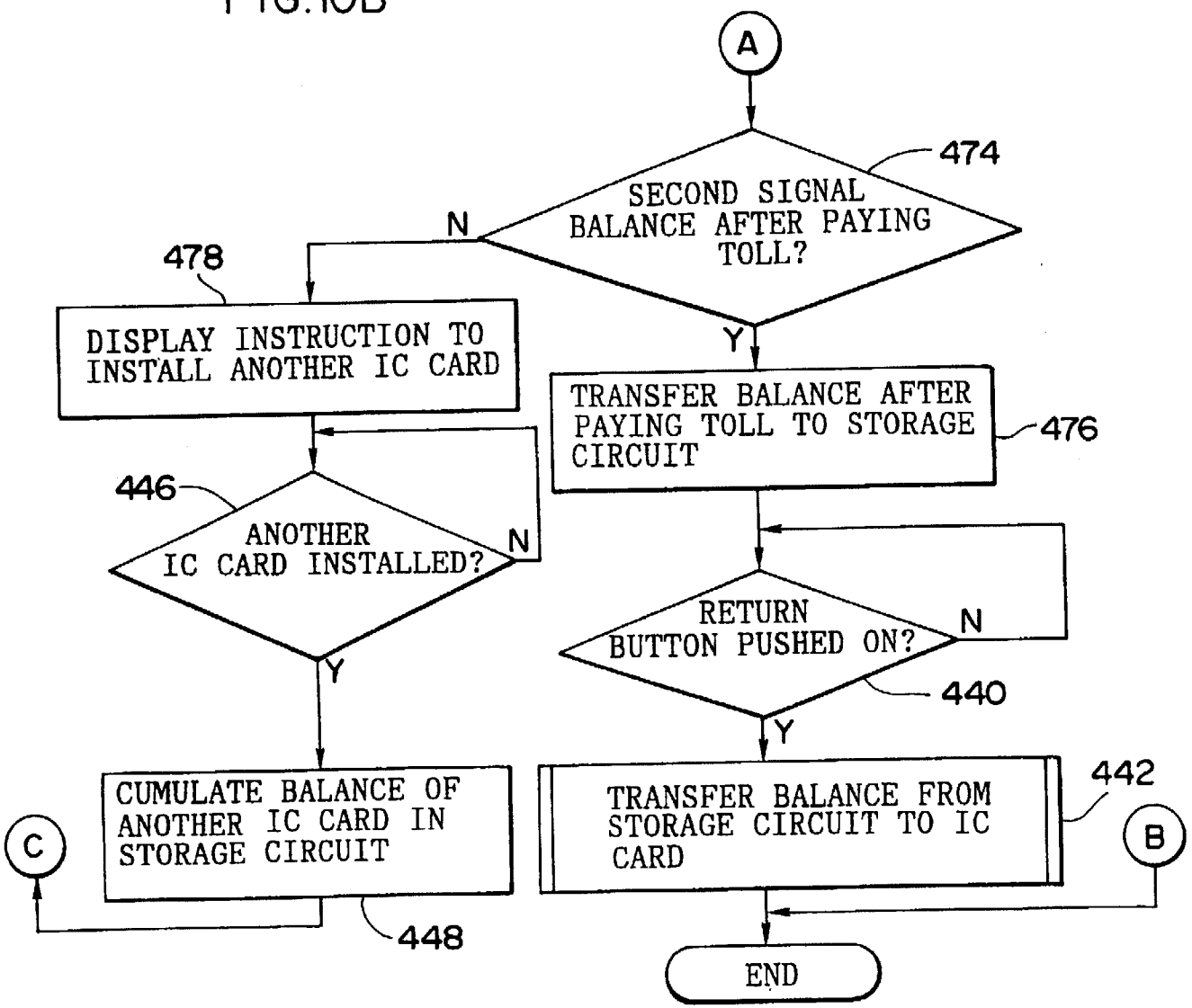
Figure 11:
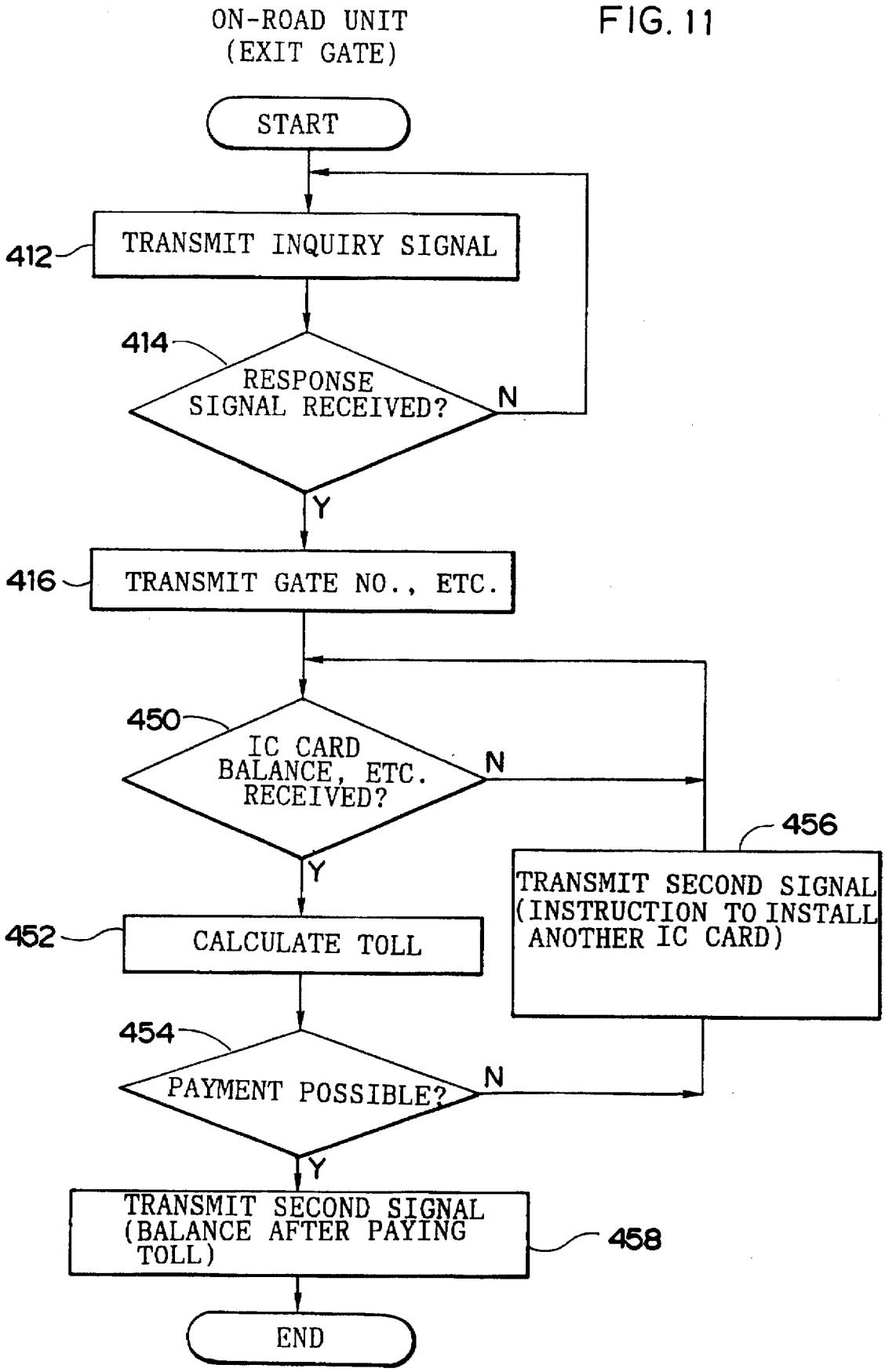
FIG. 11 is a flow chart showing a processing routine operated in an on-road unit in the second embodiment.

Next, a second embodiment will be explained. In this second embodiment, the toll is calculated by the on-road unit, and it is transmitted to the vehicle-carried unit. In FIGS. 10A, 10B and 11, parts corresponding to those in FIGS. 8A, 8B and 9 are designated by the same reference numerals, explanation of which is omitted. The balance information of IC card(s) is cumulated in the storage circuit 48 in the same manner as in the case shown in FIG. 7 in the first embodiment.

As shown in FIG. 10A, if it is judged in step 426 that a vehicle is passing through the exit gate in accordance with a signal received by the vehicle-carried unit, vehicle type information previously stored in the vehicle-carried unit and balance information stored in the storage circuit 48 of the vehicle-carried unit are transmitted to the on-road unit in step 470, and the routine waits in step 472 until a second signal from the on-road unit is received (the on-road unit transmits any one of second signals of either a balance signal after payment when payment is possible, or a signal to instruct insertion of another IC card when payment is not possible).

If the second signal received by the vehicle-carried unit is not a balance after payment of a toll in step 474, an instruction to install another IC card 62 to the IC card read/write unit 60 is displayed on the display 54 in step 478. It is desirable to attract driver's attention by producing a sound together with using the display. If another IC card 62 is installed to the IC card read/write unit 60 in step 446, balance information of the IC card is read by the IC card read/write unit 60 in step 448 and accumulated in the storage circuit 48 to proceed to step 470. Therefore, the processing routine comprising the steps 478, 446, 448, 470, 472 and 474 is repeated until it is judged that the second signal concerns a balance after paying a toll in step 474. On the other hand, if the signal transmitted from the on-road unit is a balance after paying a toll in step 474, the balance after paying the toll from the on-road unit is stored in the storage circuit 48 in step 476. If the return button is depressed in step 440, the balance information stored in the storage circuit 48 is written into IC card 62 by the IC card read/write unit 60 in step 442.

FIG. 11 shows a processing routine in the on-road unit. If it is judged in step 450 that vehicle type information and balance information transmitted from the vehicle-carried unit are received, a toll is calculated in a step 452 in accordance with the received vehicle type information and the balance information, a toll table, entrance information, route information, and exit information stored in the storage circuit of the on-road unit.

When payment is not possible in step 454, a signal to display an instruction to install another IC card to the IC card read/write unit 60 is transmitted to the vehicle-carried unit in step 456 to proceed to step 450. The routine up to step 454 is repeated until payment becomes possible.

On the other hand, when payment is possible in step 454, a balance after payment is transmitted to the vehicle-carried unit in step 458.

According to this embodiment as described above, a plurality of IC cards 62 can be used upon payment of a toll, and the calculation is performed by the on-road unit. Thus the load of the vehicle carried unit can be relieved to allow the vehicle-carried unit to have a small size and a light weight.

An example, in which the vehicle type information is stored in the storage circuit 48 of the vehicle-carried unit, has been explained in the second embodiment. However, the vehicle type may be detected by the vehicle type detecting system 360, and detected vehicle type information may be transmitted from the vehicle type detecting system 360 to the on-road unit.

Alternatively, in order to inform the on-road unit of the fact that the balance in the storage circuit 48 is the balance after payment received by the vehicle-carried unit, a step may be provided between steps 476 and 440 in FIG. 10B so that the balance is transmitted to the on-road unit, its signal is received after the step 458 in FIG. 11, and it is judged whether or not the balance already received in the step 458 is equal in amount to the received balance to confirm that the toll has been certainly paid.

When payment is not possible in step 454, a shortage amount may be calculated in step 456, and the shortage amount may be transmitted to the vehicle-carried unit. In this case, in addition to displaying of the shortage amount on the display 54 in step 478 in FIG. 10B, it is desirable to attract the driver's attention by also producing a sound.

Next, details of step 442 in FIGS. 8B and 10B will be explained.

Figure 12:
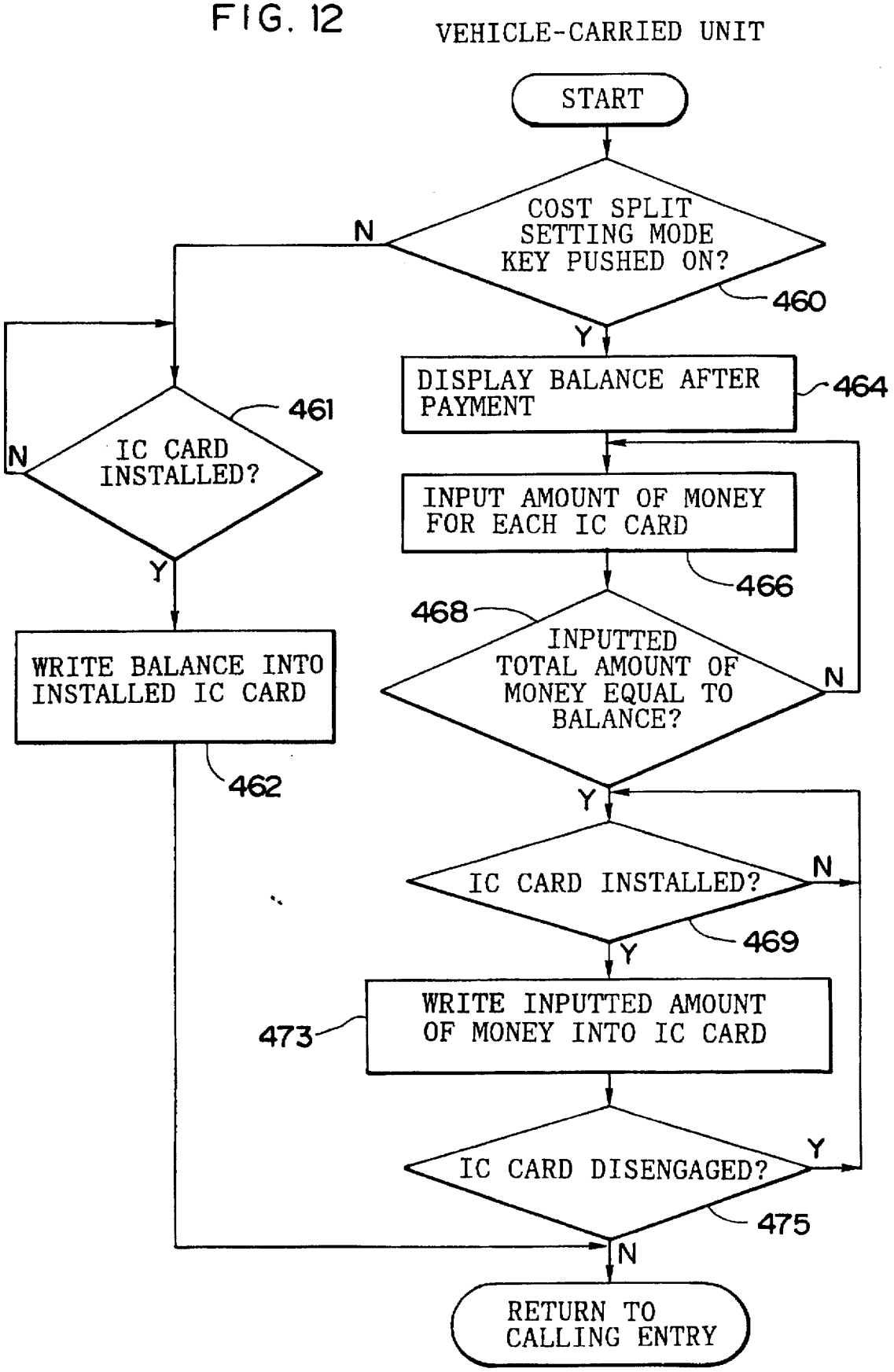
FIG. 12 is a flow chart showing details of a step 442.

As shown in FIG. 12, it is judged in step 460 whether or not a predetermined cost split setting mode key of the ten key 56 is depressed. When the key is not depressed, the routine waits until an IC card 62 is installed in step 461. If it is installed (or if is has been already installed), balance information is written into the IC card presently installed from the storage circuit 48 in step 462. When the key is depressed, balance information after paying a toll is displayed on the display 54 in a step 464.

If an amount of money to be written into each IC card is inputted from the ten key 54 in a step 466, it is judged in a step 468 whether or not an inputted total amount of money is equal to the balance after payment. In the case of being equal, the routine waits until an IC card is installed in a step 469, and the inputted amount of money is sequentially written into each IC card in a step 471.

According to this embodiment as described above, an optional amount of money can be written into an optional IC card. As a result, so-called cost split processing becomes possible, and the management of IC cards becomes easy. For example, when a driver has a large number of cards, balances of predetermined IC cards are made zero, and the balance information is written into another IC card. Thus, IC cards having a balance of zero may be discarded, and only the IC card in which the balance information is written may be managed.

Third Embodiment

Figure 13:
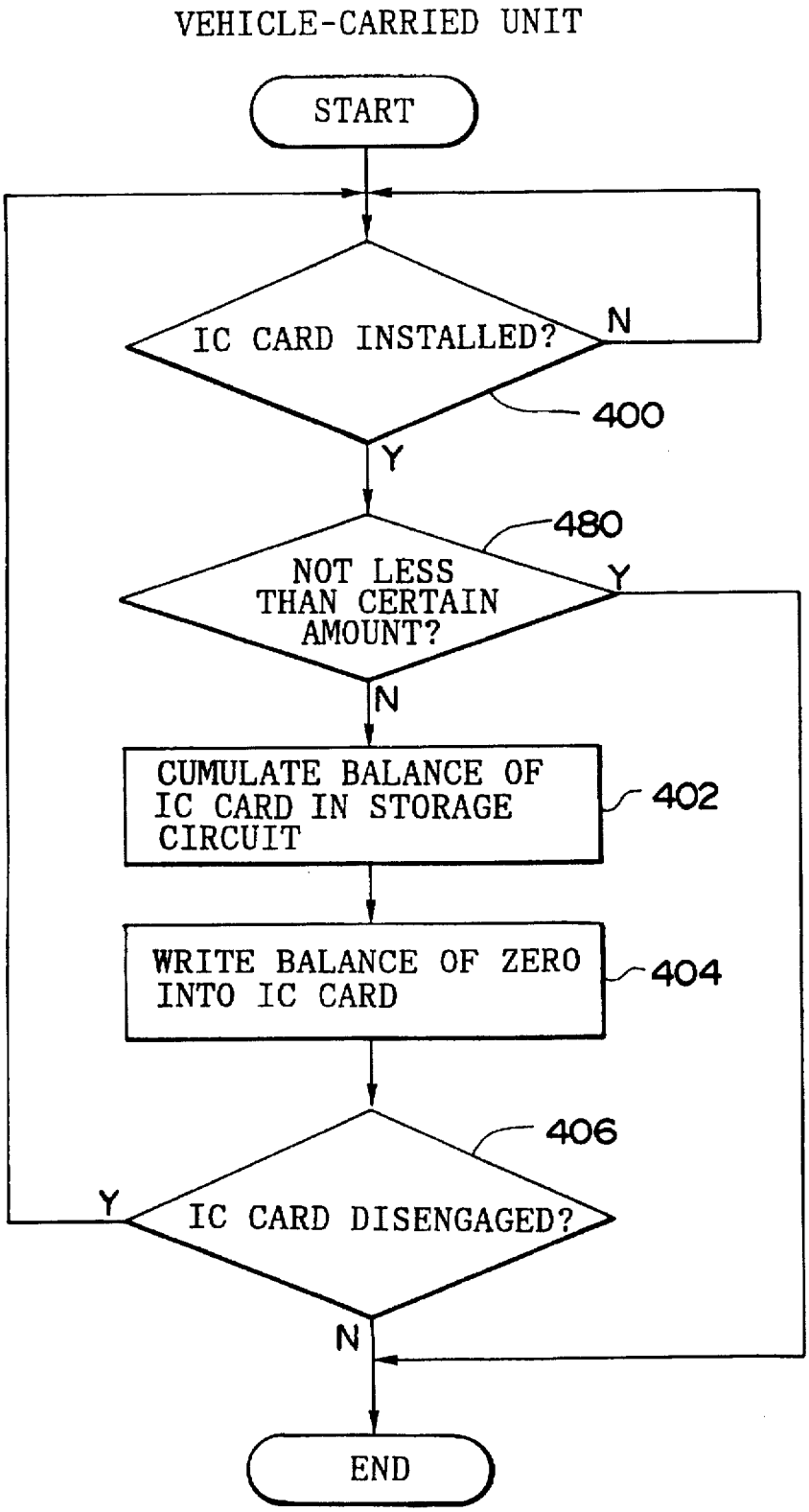
FIG. 13 is a flow chart showing accumulation processing routine for balance information of an IC card operated in a vehicle-carried unit in a third embodiment.
Figure 14A:
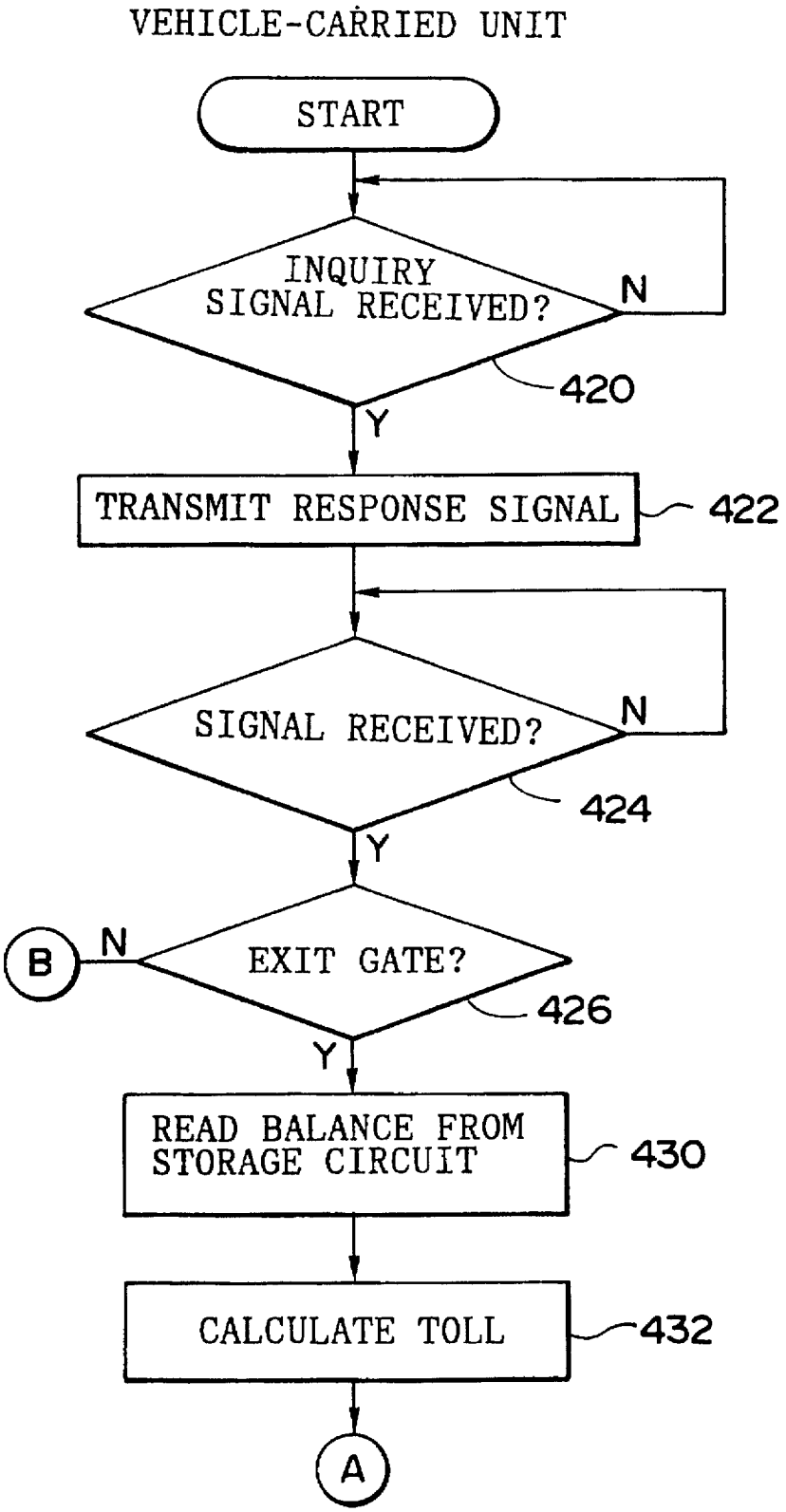
FIGS. 14A and 14B are a flow chart showing a processing routine operated in a vehicle-carried unit in the third embodiment.

Next, a third embodiment will be explained. In this embodiment, if the balance of an IC card 62 is not more than a certain amount, then all of the balance is accumulated (pooled) in storage circuit 48, and, if payment is possible, the toll is paid by using the pooled balance. When there is a shortage, the amount of the shortage is subtracted from the balance information of the installed IC card. Even if a total of those in the storage circuit 48 and an installed IC card 62 is not enough for a toll, the balance in the storage circuit 48 is made negative, and the toll is paid. In FIGS. 13, 14A and parts corresponding to those in FIGS. 7, 8A and 8B are designated by the same reference numerals, explanation of which is omitted. The on-road unit is the same as that in FIG. 9 described in the first embodiment.

In FIG. 13, balance information of an IC card 62 installed in the IC card read/write unit 60 is read, and it is pooled in the storage circuit 48 when the balance is not more than a certain amount (for example, 10 dollars). If an IC card 62 is installed in step 400, its balance is read in a step 480. When the balance is not less than the certain amount, the processing routine ends. In the case of being not more than the certain amount, balance information of the IC card 62 is accumulated in the storage circuit 48 in steps 402, 404, and a balance of zero is written into IC card 62.

Figure 14B:
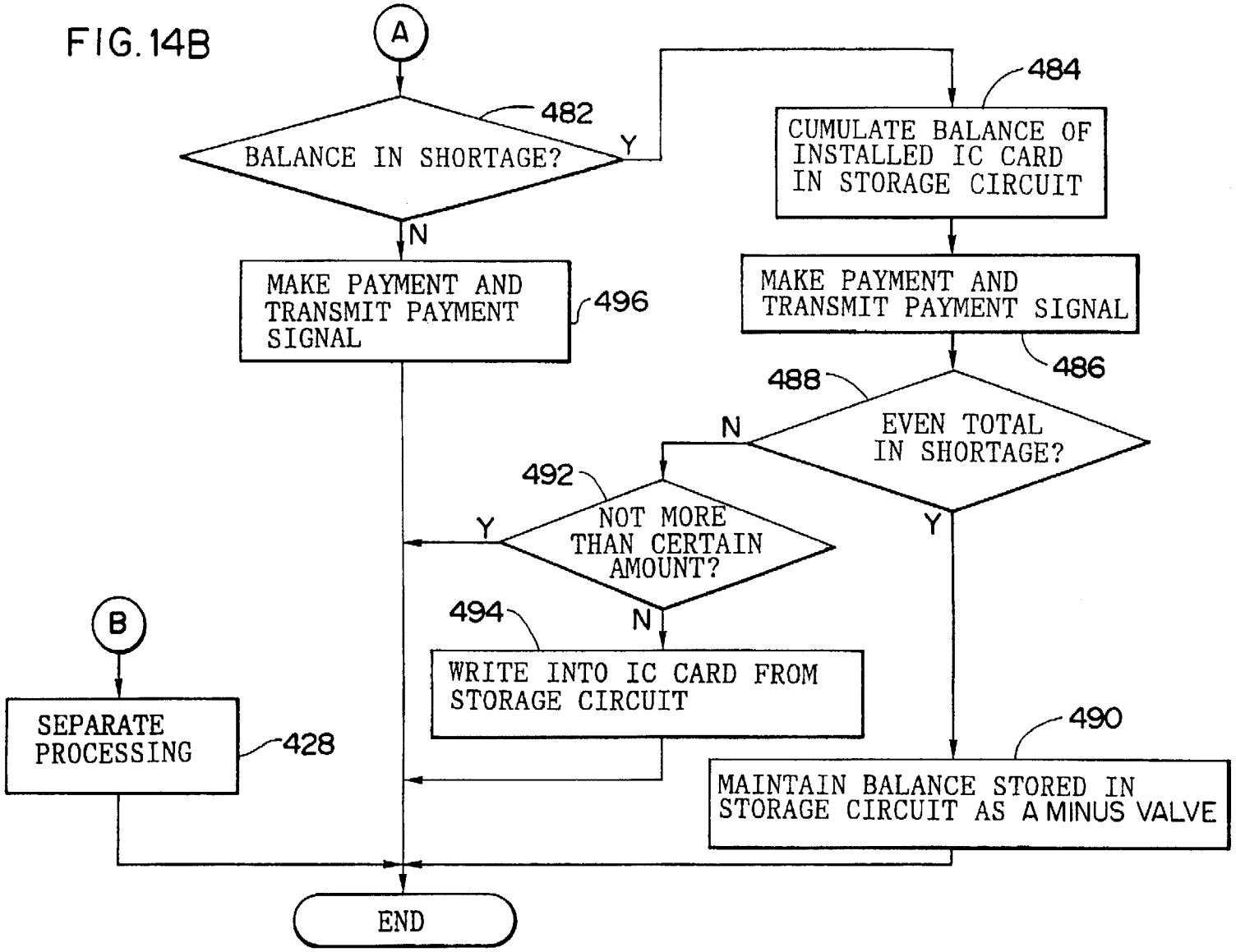

As shown in FIGS. 14A and 14B, if it is judged in step 426 that a vehicle is passing through the exit gate in accordance with a signal received by the vehicle-carried unit, balance information accumulated in the storage circuit 48 is read in step 430, and a toll is calculated in a step 432. In step 482, it is judged whether or not the toll can be paid by using the balance information stored in the storage circuit 48.

When payment is possible, receipt is made in step 496, and a payment signal is transmitted to the on-road unit to end the processing routine.

When there is a shortage, balance information of the IC card 62 installed in the IC card read/write unit 60 is read in step 484 to obtain a total of the read balance and the accumulated balance information already stored in the storage circuit. A toll is subtracted from the total in step 486, and a payment signal is transmitted to the on-road unit to pay the toll. However, even if the total balance is not enough for the toll in step 488, the balance stored in the storage circuit 48 is maintained as negative (step 488), and the processing routine ends. On the contrary, if the toll can be paid by the total amount, it is judged in step 492 whether or not the balance is not more than a certain amount. When it is not more than the certain amount, the balance information is held (pooled) as it is in the storage circuit 48, and the processing routine ends. When the balance is not less than the certain amount, the balance information in the storage circuit 48 is written into the IC card 62 in step 494, and the processing routine ends.

Figure 15:
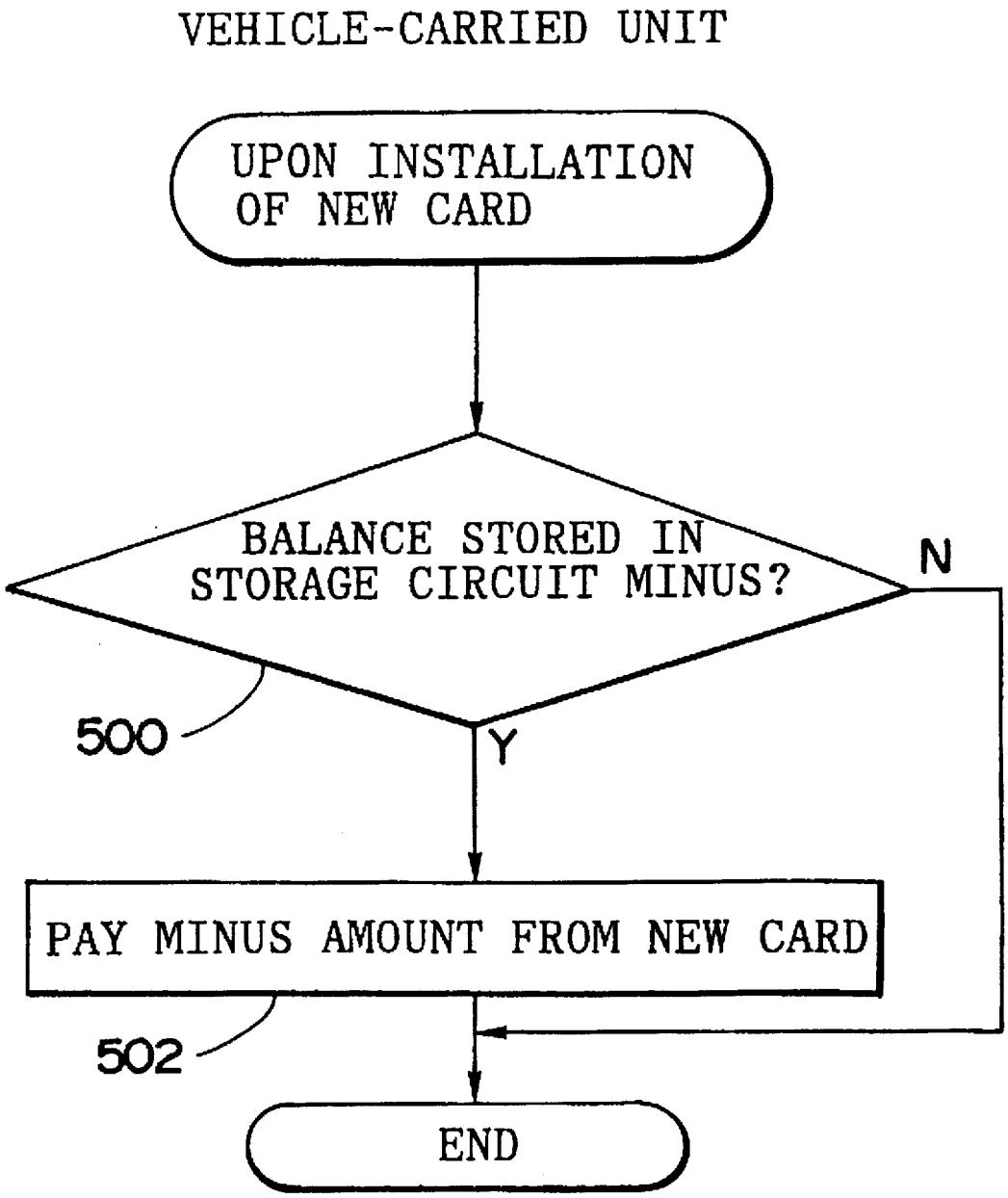
FIG. 15 is a flow chart showing a processing routine after balance information in a storage circuit operated in the vehicle-carried unit becomes minus in the third embodiment.

Subsequently, as shown in FIG. 15, if a new IC card 62 is installed to the IC card read/write unit 60, it is judged in step 500 whether or not the balance information stored in the storage circuit 48 is negative. When it is negative, the amount representing the shortage is subtracted from the new IC card 62 in step 502, and the payment of the shortage amount of the toll is completed.

In this embodiment as described above, if the balance of an IC card is not more than the certain amount, it is pooled in the storage circuit. As a result, the balance of an IC card can be ultimately exhausted, and a crowded situation at a tollbooth can be relieved even when a shortage exists because it is not necessary to stop immediately at the tollbooth to pay the difference.

An explanation of approval for deferred payment of the shortage amount as described above follows. It can be postulated that a driver who has once passed through a toll road may utilize the toll road again even after a certain time interval has elapsed. The shortage amount can be recovered at that later time. The disadvantage of waiting for a driver with a shortage to use the road again is small, while the benefit of preventing a crowded situation at a tollbooth is great. However, if the shortage amount is greater than a certain amount (for example, 300 dollars), it is postulated that the shortage amount would be difficult to recover. Accordingly, if the shortage amount is greater than a certain amount, deferred payment for a shortage amount exceeding it may be prohibited. In such a case, in addition to displaying a message on the display 54, it is desirable to attract the driver's attention by producing a sound. In this third embodiment, a toll table and so on is stored beforehand in the vehicle-carried unit to calculate a toll. However, it is also possible for toll calculation to be performed in the on-road unit during communication, and the balance after paying the toll transmitted from the on-road unit to the vehicle-carried unit as in the second embodiment.

Further, if the driver's attention is attracted by a sound produced in step 484, and a timer or the like is set to give a certain amount of time for the installation of an IC card 62, then a driver can install a plurality of IC cards to the IC card read/write unit 60 so that balance information in the storage circuit 48 does not become negative.

Fourth embodiment

Figure 16A:
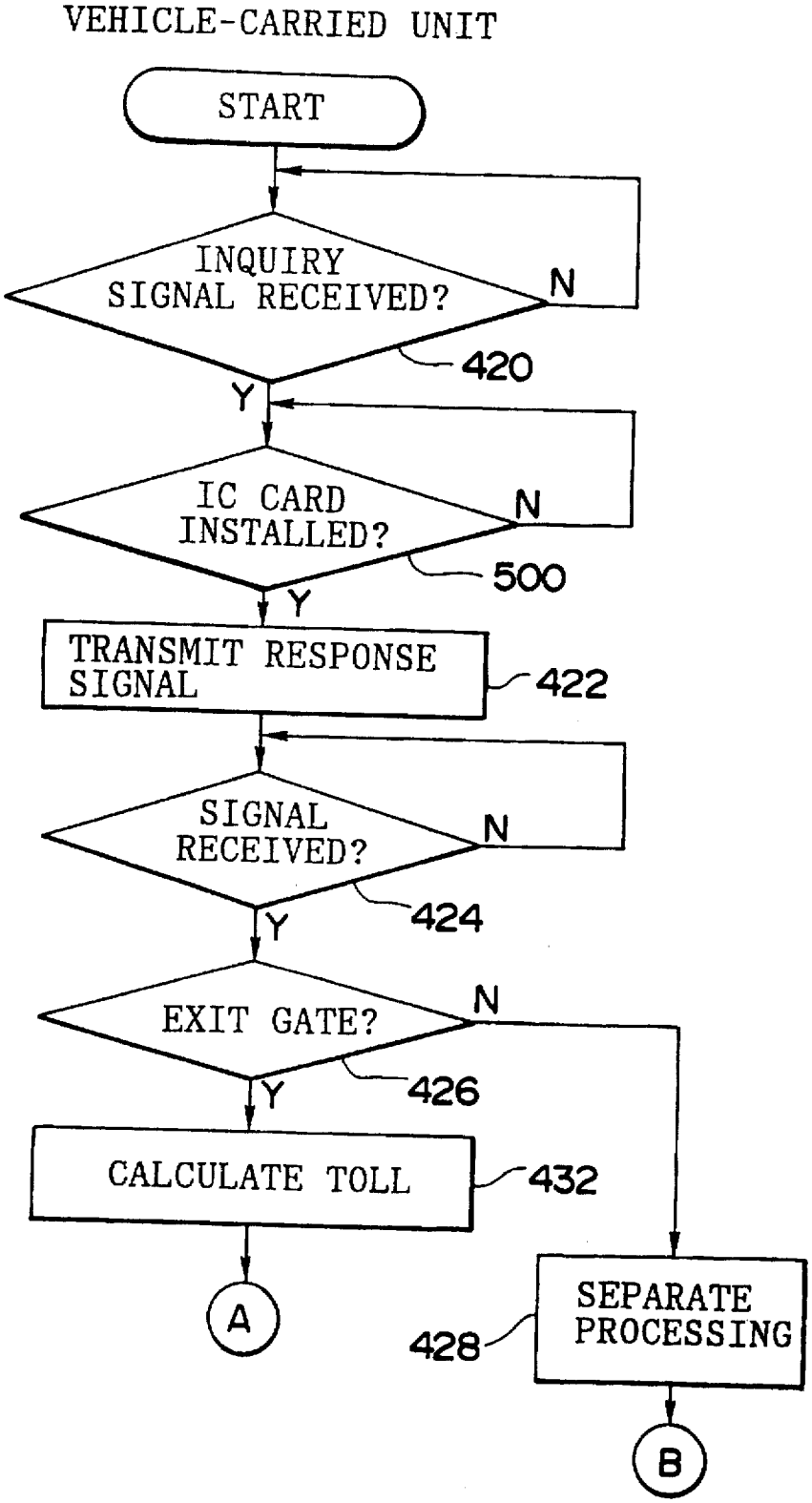
FIGS. 16A and 16B are a flow chart showing a processing routine operated in a vehicle-carried unit in a fourth embodiment.
Figure 16B:
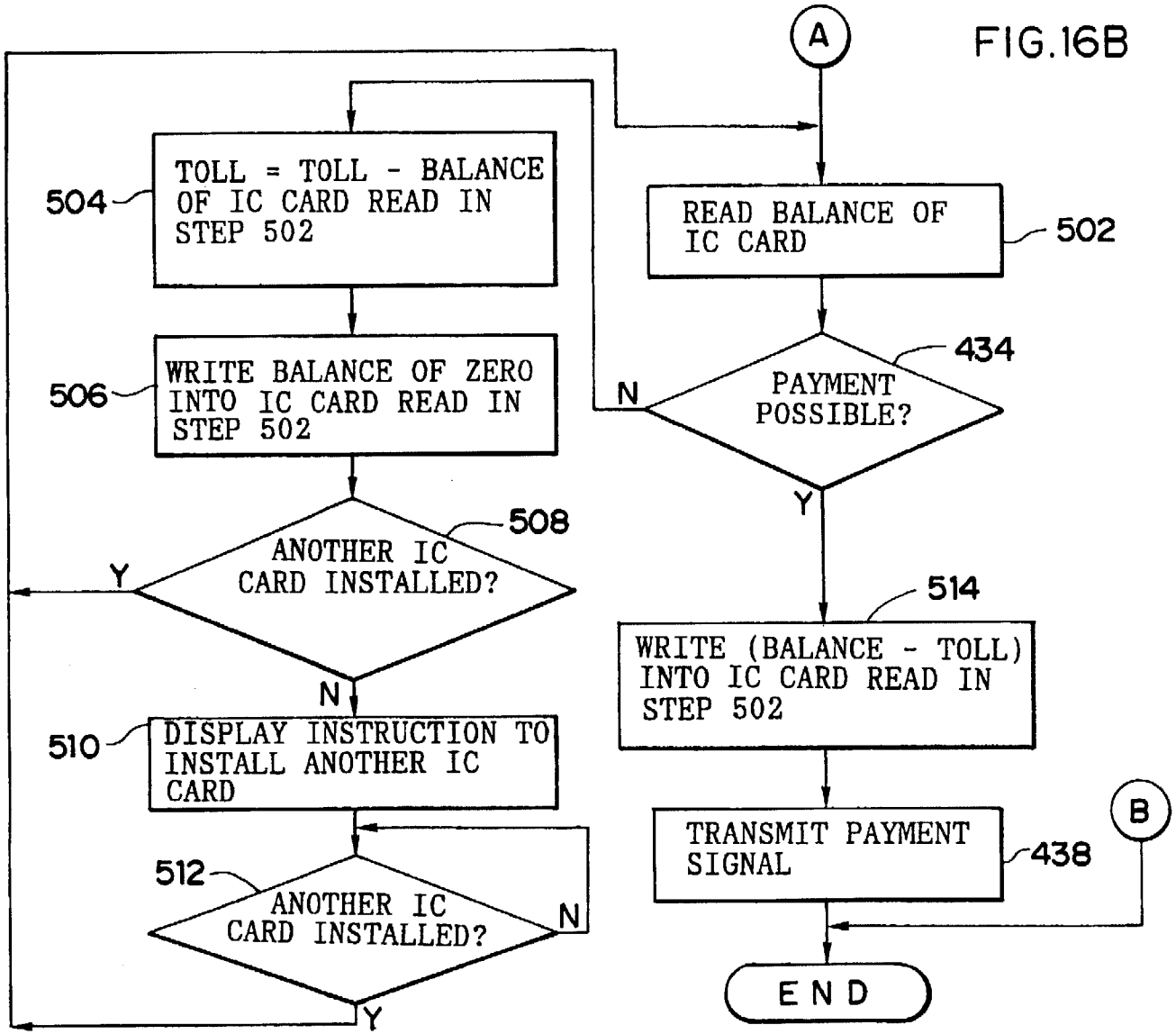

Next, a fourth embodiment will be explained. This embodiment presents an example in which the IC card read/write unit 60 has a plurality of installation ports for installing IC cards 62 as described above, and a plurality of IC cards 62 can be simultaneously installed, however, the storage circuit 48 does not store balance information. In FIGS. 16A and 16B, parts corresponding to those in FIGS. 8A and 8B are designated by the same reference numerals, explanation of which is omitted. The on-road unit is the same as that in FIG. 9 explained in the first embodiment.

As shown in FIGS. 16A and 16B, if an IC card 62 is installed in step 500, a response signal is transmitted in step 422, and a signal from the vehicle-carried unit is received in step 424. If it is judged in step 426 that a vehicle is passing through the exit gate in accordance with a signal received by the vehicle-carried unit, a toll is calculated in step 432. Balance information of the IC card 62 is read in step 502, and it is judged in step 434 whether or not the toll can be paid.

When payment is not possible, a toll (=toll−balance of IC card 62 read in step 502) is calculated in step 504, and a balance of zero is written in step 506 into the IC card 62 read in step 502. If another IC card 62 is installed the IC card read/write unit 60 in step 508, the routine proceeds to step 502 to read the balance information of the other installed IC card 62 to be accumulated to the already read balance information. It is judged again in step 434 whether or not payment can be made. If no IC card is installed, an instruction to install another IC card 62 is displayed on the display 54 in step 510. Upon installation, the routine proceeds to step 502 to read balance information of the other installed IC card 62 to be accumulated to the balance information already read. It is judged again in the Step 434 whether or not payment can be made.

On the other hand, when payment can be made, balance information (balance−toll) is written in step 514 into the IC card 62 read in step 502, and a payment signal is transmitted to the on-road unit in step 438 to end the processing routine.

In this embodiment as described above, the storage circuit 48 does not store the balance information. However, the IC card read/write unit 60 has a plurality of installation ports to which a plurality of IC cards 62 may be installed. Thus the toll can be sequentially subtracted from the plurality of IC cards 62.

According to this embodiment as described above, the toll can be paid by using balance information of a plurality of recording media without providing any storage circuit 48 in the vehicle-carried unit. Thus, it is unnecessary to stop at a tollbooth to update the IC card in the same manner as in the first embodiment.

In the fourth embodiment, a toll table and so on is stored beforehand in the vehicle-carried unit to calculate the toll. However, it is also possible for the toll calculation to be performed in the on-road unit during communication, and the balance after paying the toll transmitted from the on-road unit to the vehicle-carried unit as in the second embodiment.

Fifth Embodiment

Figure 17A:
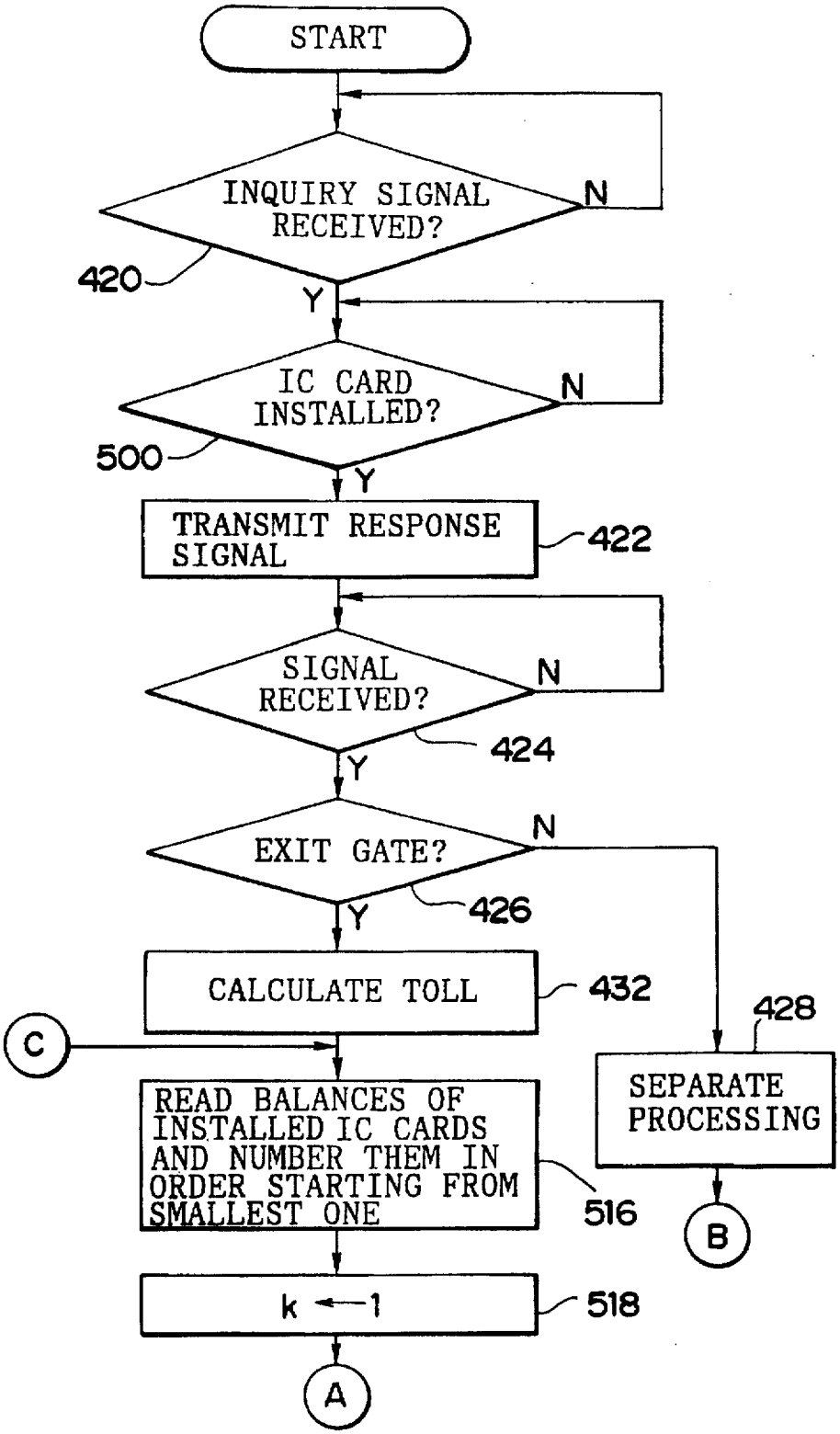
FIGS. 17A and 17B are a flow chart showing a processing routine operated in a vehicle-carried unit in a fifth embodiment.
Figure 17B:
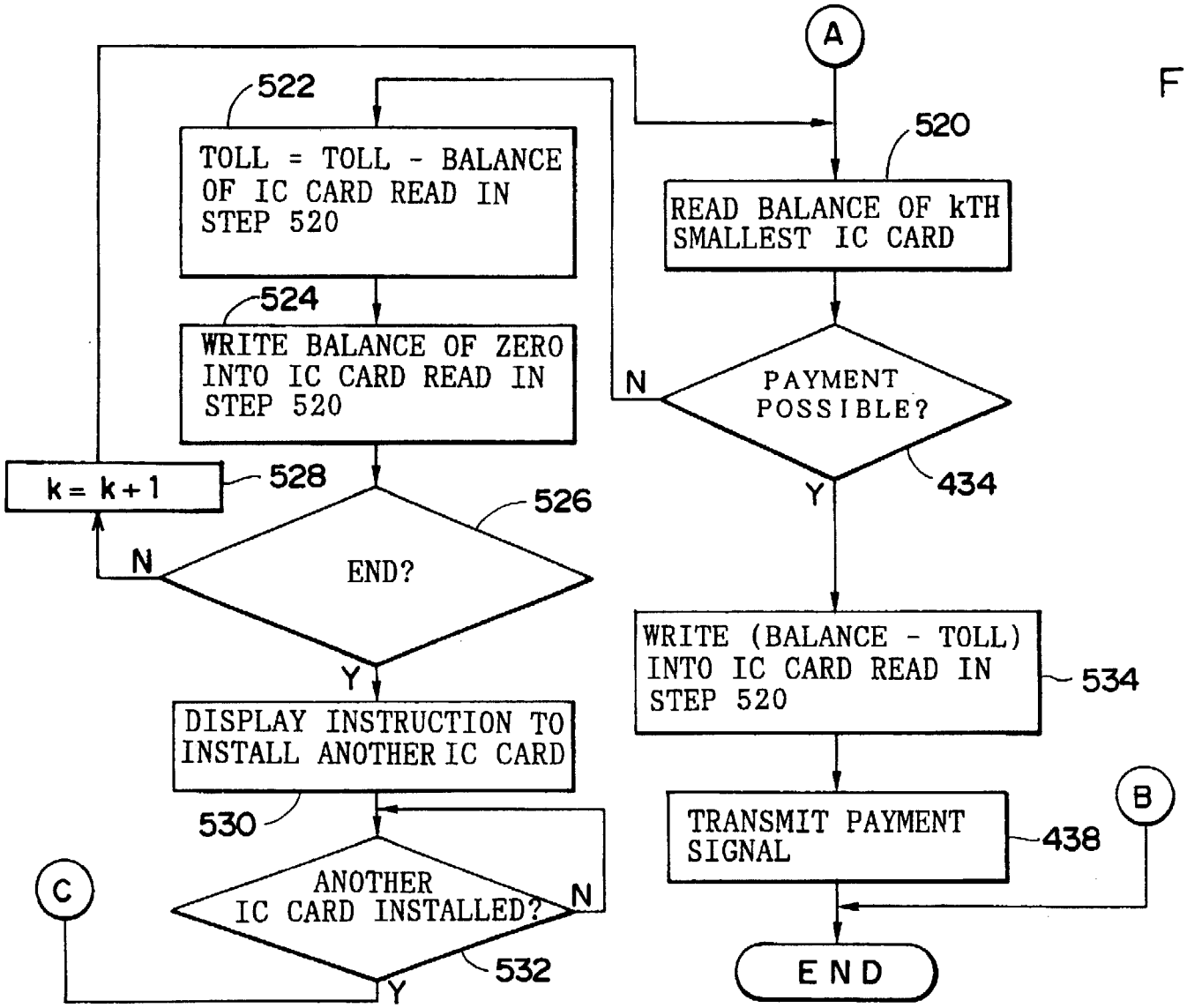

Next, a fifth embodiment will be explained. In this embodiment, a plurality of IC cards 62 installed to the IC card read/write unit 60 are subjected to subtraction in an order starting from one having the smallest balance until a toll is satisfied. This embodiment presents an example in which balance information is not stored in the storage circuit 48 in the same manner as in the fourth embodiment. In FIGS. 17A and 17B, explanation of parts corresponding to those in FIGS. 16A and 16B is omitted.

As shown in FIGS. 17A and 17B, balance information of a plurality of installed IC cards 62 is read in step 516, the IC cards 62 are numbered in order starting from one having the smallest balance, and k is substituted by 1 in step 518. This enables subtraction of a toll in an order starting from a card having the smallest balance.

Balance information of an IC card 62 having the kth smallest balance is read in step 520. It is judged in step 434 whether or not a toll can be paid by using the balance of the IC card having the kth smallest balance.

When payment cannot be made, toll (=toll−balance of IC card 62 read in step 520) is calculated in step 522. A balance of zero is written in step 524 into the IC card 62 read in step 520. If an IC card having a larger balance is installed in a step 526, k=k+1 is given in a step 528, and the routine proceeds to the step 520. On the other hand, if no IC card having a larger balance is installed in step 526, an instruction to install another IC card is displayed on the display 54 in step 530. If another IC card is installed in step 532, the routine proceeds to step 516. Therefore, the processing routines comprising steps 434, 522, 524, 526 and steps 528, 520, or steps 434, 522, 524, 526 and steps 530, 532, 516, 518, 520 are repeated until payment can be made in step 434.

When payment can be made, balance information of (balance−toll) is written in step 534 into the IC card 62 read in step 520. A payment signal is transmitted to the on-road unit in step 438, and the processing routine ends.

According to this embodiment as described above, the toll is subtracted in an order starting from an IC card having the smallest balance. Thus, IC cards can be exhausted in an order starting from one having the smallest balance so that used IC cards can be discarded, making the driver's management of IC cards easier.

Sixth Embodiment

Figure 18A:
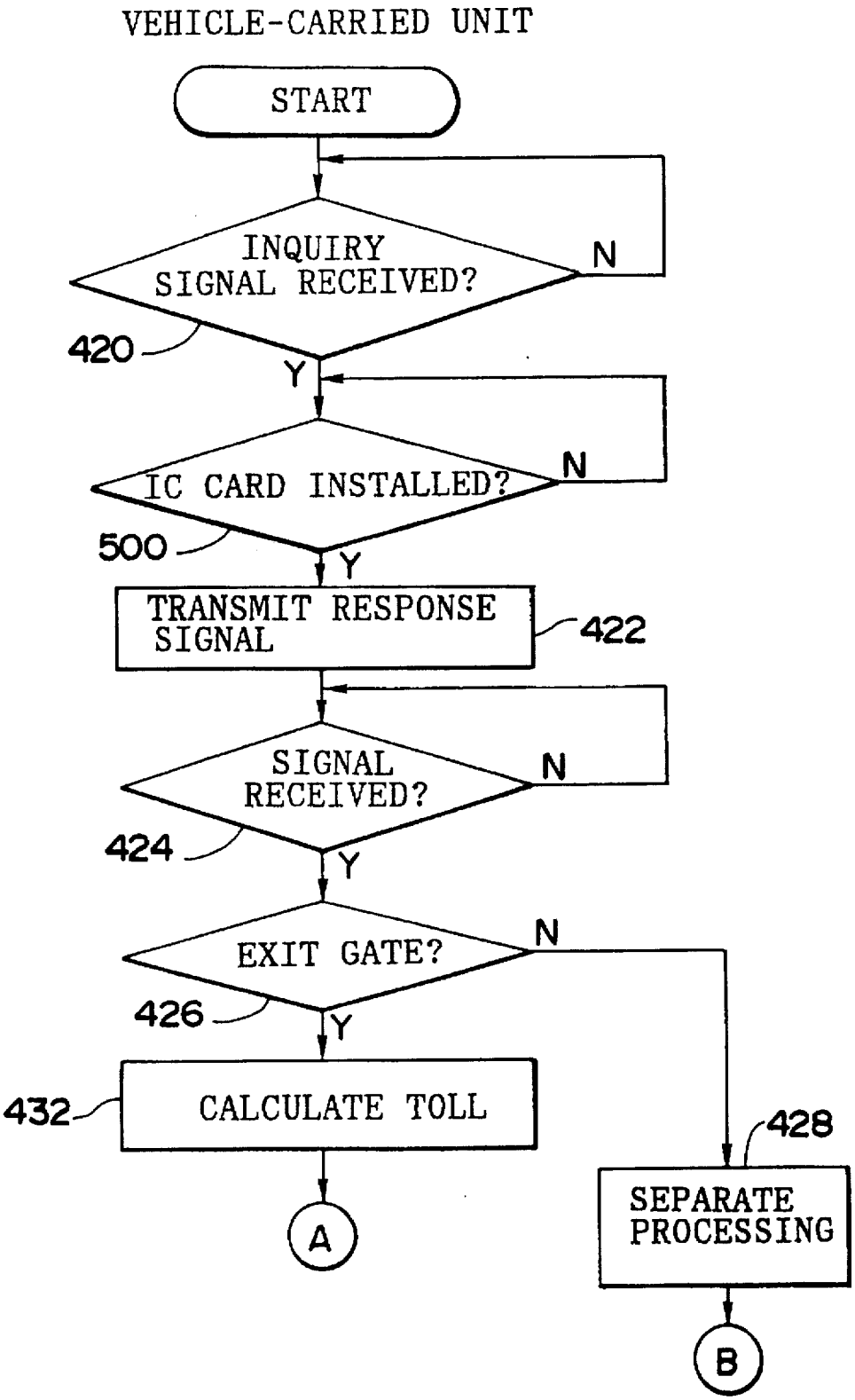
FIGS. 18A and 18B are a flow chart showing a processing routine operated in a vehicle-carried unit in a sixth embodiment.
Figure 18B:
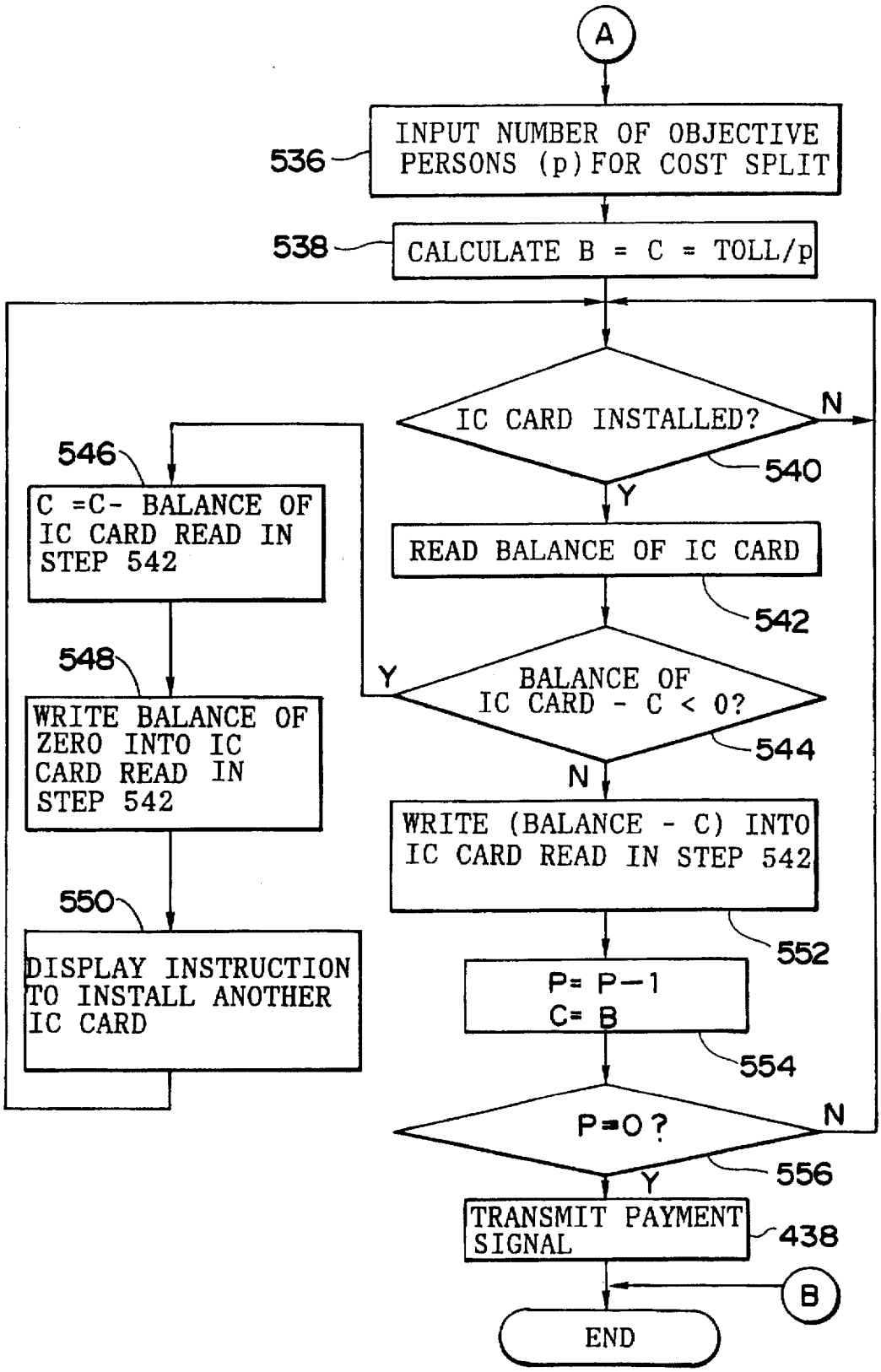

Next, a sixth embodiment will be explained. In this embodiment, so-called cost split processing is conveniently performed with respect to a predetermined number of objective persons. This embodiment presents an example in which no balance information is stored in the storage circuit 48 in the same manner as in the fourth embodiment. In FIGS. 18A and 18B, explanation of parts corresponding to those in FIGS. 16A and 16B, designated by the same reference numerals, is omitted.

As shown in FIGS. 18A and 18B, a toll is calculated in step 432. A number of objective persons for cost split (p) is inputted from the ten key 56 in step 536. B=C=toll/p is calculated in step 538.

If an IC card 62 is installed in step 540, balance information of the installed IC card 62 is read in step 542. It is judged in step 544 whether balance of installed IC card 62−C is negative.

When it is negative, C=(C balance of IC card read in step 542) is calculated in step 546, and a balance of zero is written in step 548 into the IC card 62 read in step 542. An instruction to install another IC card 62 is displayed on the display 54 in step 550, and the routine proceeds to step 540. Accordingly, even if the balance of an IC card possessed by an objective person for cost split processing is inadequate another IC card is installed, and thus a shortage amount can be subtracted from another installed IC card.

When the balance information is judged not to be negative, balance information (balance−C) is written in step 552 into the IC card read in the step 542, and p=p−1, C=B are calculated in step 554. It is judged in step 556 whether or not p=0. When p=0, the processing routine ends. In the case of p not=0, the routine proceeds to step 540, and waits until an IC card of another objective person is installed. Upon installation, the same processing routine as that described above is executed for the IC card of the other objective person for cost split processing.

According to this embodiment as described above, a certain amount is subtracted from IC cards corresponding to a number of objective persons. Thus, cost split processing becomes easy.

If a remainder is generated in step 538, input from ten key 56 can indicate with which IC card the remainder is to be processed. The remainder can be processed by making C in step 544 (C+remainder).

In this embodiment, cost split processing concerning objective persons has been explained. However, it is also possible to perform cost split processing for each card in the same manner.

In this embodiment, the calculation processing for cost split processing has been performed in the vehicle-carried unit. However, it can be also performed in the on-road unit.

Seventh Embodiment

Next, a seventh embodiment will be explained. In this embodiment, when balance information is written into an IC card 62 by the IC card read/write unit 60 (in step 442 and the like described above), if a failure occurs in the IC card 62, the driver is informed of the failure, and the balance information is written into another IC card 62.

Figure 19:
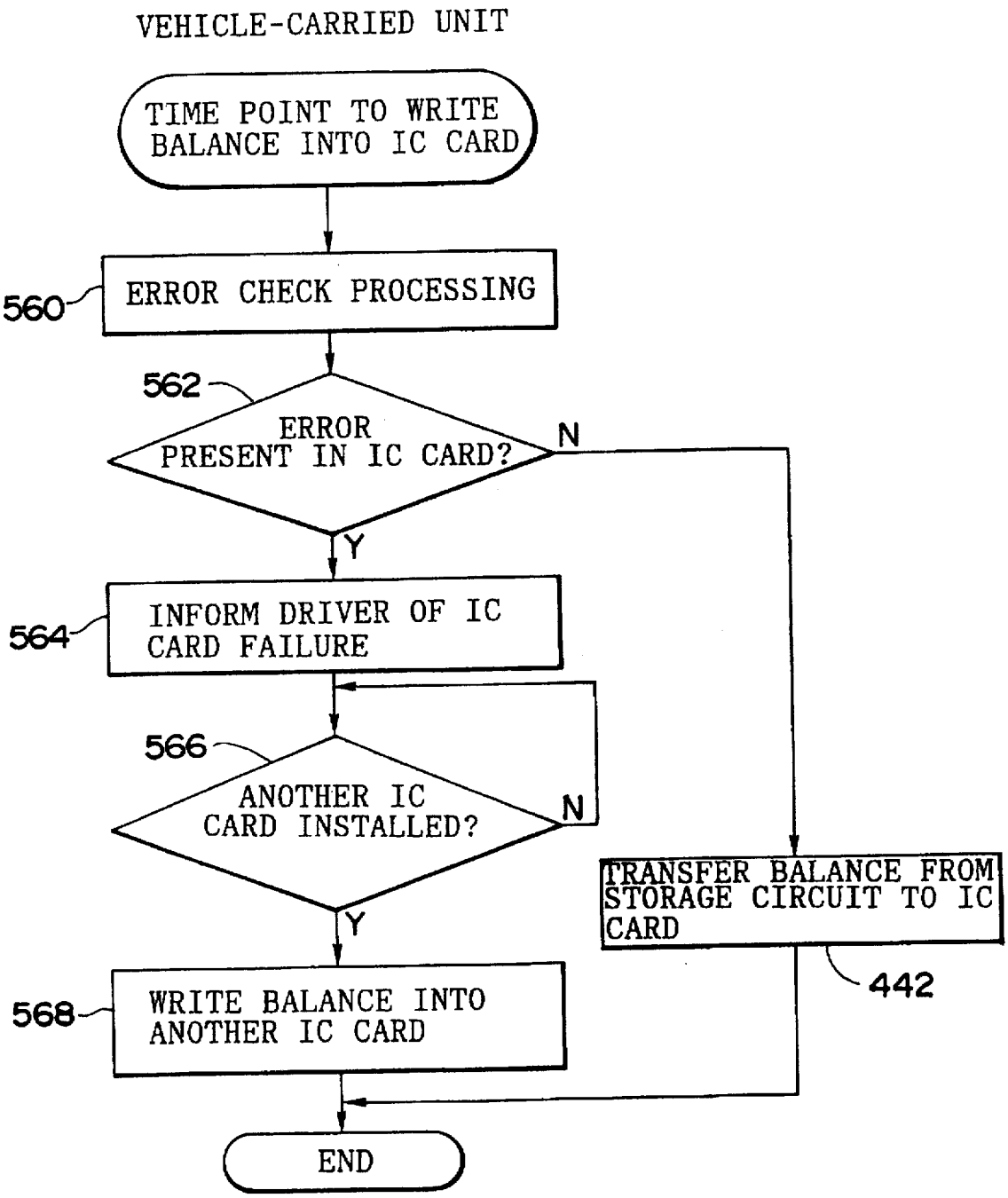
FIG. 19 is a flow chart showing a processing routine operated in a vehicle-carried unit in a seventh embodiment.

If the error detecting circuit 61 detects no failure of the IC card 62 in step 562 in FIG. 19, a balance in storage circuit 48 is written into IC card 62 by the IC card read/write unit 60 in an ordinary manner in accordance with step 442 shown in FIG. 19.

On the other hand, if the error detecting circuit 61 detects an error of the IC card 62 in step 562, the failure is displayed on the display 54 in step 564. A sound may be generated in order to attract driver's attention. The routine waits until another IC card 62 having no failure is installed in the IC card read/write unit 60 in step 566. Upon installation, balance information stored in the storage circuit 48 is written in step 568.

If a different IC card 62 on which other balance information is recorded is installed in step 566, the balance information of the different IC card 62 is read by the IC card read/write unit 60 and stored in the storage circuit 48. The balance information which was to be written into the failed IC card is added to the balance information of the different IC card to obtain a total. The total balance information may be written into the different IC card by the IC card read/write unit 60.

According to this embodiment as described above, when the IC card is damaged, balance information stored in the storage circuit is read, and an IC card having the balance can be reissued.

In this embodiment, the processing routine in the vehicle-carried unit has been explained. However, the same processing routine can be also executed in the on-road unit.

If a unit for detecting failure of the IC card read/write unit .is further provided separately, it becomes possible to judge whether the IC card 62 or the IC card read/write unit 60 has a failure. In addition, a failure upon reading as well as writing can be detected.

In the embodiments described above, examples have been explained in which the driver is instructed to install the IC card(s) at the exit gate when a balance shortage occurs. However, it is also acceptable that the driver is instructed to install the IC card upon getting into the vehicle, and the driver prevented from disengaging the IC card while the vehicle is running.

What is claimed is:

1. An automatic toll-paying system carried on a vehicle for automatically paying a toll charge through communication with an on-road unit installed on a road, said automatic toll-paying system comprising:

reading and accumulating means for reading respective balance information from each of a plurality of physically separate recording media and accumulating said respective balance information into a total balance; and transmitting means for transmitting said total balance accumulated in said reading and accumulating means to said on-road unit to automatically pay said toll charge.

2. An automatic toll-paying system carried on a vehicle for automatically paying a toll charge through communication with an on-road unit installed on a road, said automatic toll-paying system comprising:

reading and accumulating means for reading respective balance information from each of a plurality of physically separate recording media and accumulating said respective balance information into a total balance; and control means for paying said toll through communication with said on-road unit in accordance with said total balance accumulated in said reading and accumulating means, respective new balance information being recorded on each of said plurality of physically separate recording media after said toll charge is paid.

3. The automatic toll-paying system according to claim 2, further comprising:

charge-paying means for allowing a driver to designate said respective new balance information to be recorded on each of said plurality of physically separate recording media;

said control means further for controlling recording of said respective new balance information on each of said plurality of physically separate media after paying said toll charge.

4. The automatic toll-paying system according to claim 2, further comprising:

warning means for giving a warning when said toll charge is larger than said total balance.

5. The vehicle-carried unit for automatic toll-paying systems according to claim 2, further comprising:

display means for displaying at least one of a payment amount obtained through communication with said on-road unit, said total balance before paying said toll charge, and a new total balance after paying said toll charge.

6. The automatic toll-paying system according to claim 5, wherein:

said display means displays at least one of said respective balance information before paying said toll charge and said respective new balance information after paying said toll charge for each of said plurality of physically separate recording media.

7. The automatic toll-paying system according to claim 5, further comprising:

display-prohibiting means for prohibiting display of at least one of said payment amount obtained through communication with said on-road unit, said total balance before paying said toll charge, and said total balance after paying said toll charge.

8. An automatic toll-paying system carried on a vehicle for automatically paying a toll charge through communication with an on-road unit installed on a road, said automatic toll-paying system comprising:

detecting means for detecting that respective balance information recorded on each of a plurality of physically separate recording media is not greater than a predetermined amount;

reading and accumulating means for reading said respective balance information and adding said respective balance information to an accumulated balance when said detecting means detects that said respective balance information is not greater than said predetermined amount; and control means for paying said toll charge through communication with said on-road unit in accordance with a total balance, said total balance being a sum of said accumulated balance and said respective balance information from one of said plurality of physically separate recording media having said respective balance information exceeding said predetermined amount.

9. The automatic toll-paying system according to claim 8, further comprising:

shortage amount accumulating means for accumulating, when said toll charge is larger than said total balance, a shortage amount equal to said total balance minus said toll charge.

10. The automatic toll-paying system according to claim 9, further comprising:

display means for displaying said shortage amount.

11. The automatic toll-paying system according to claim 9, wherein: said shortage amount accumulating means prohibits accumulation of said shortage amount having an absolute value not less than a shortage-limit amount.

12. The automatic toll-paying system according to claim 11, further comprising:

warning means for giving a warning when said absolute value of said shortage amount is not less than said shortage-limit amount.

13. An automatic toll-paying system carried on a vehicle for automatically paying a toll charge through communication with an on-road unit installed on a road, said automatic toll-paying system comprising:

accepting means for accepting a plurality of physically separate recording media, respective balance information having been recorded on each of said plurality of physically separate media; and control means for reading a total balance information after paying said toll charge obtained through communication with said on-road unit and recording said total balance information as said respective balance information on at least one of said plurality of physically separate recording media accepted by said accepting means.

14. An automatic toll-paying system according to claim 13, wherein:

said control means subtracts said respective balance information from said toll charge in an order starting from said respective balance information from one of said plurality of physically separate recording media having said respective balance information smaller than said respective balance information recorded on each remaining recording medium of said plurality of physically separate recording media, said control means records a respective new balance information onto said one of said plurality of physically separate recording media, said respective new balance information is 0 when said toll charge is not less than said respective balance information, said respective new balance information equals said toll charge subtracted from said respective balance information when said toll charge is less than said respective balance information.

15. An automatic toll-paying system according to claim 13, wherein:

said control means subtracts a predetermined amount from each of said plurality of physically separate recording media.

16. An automatic toll-paying system according to claim 15, further comprising:

remainder-paying means for allowing a driver to designate one of said plurality of physically separate recording media from which a remainder is to be subtracted;

said control means subtracting said predetermined amount and said remainder from said one of said plurality of recording media designated by said remainder-paying means.

17. An automatic toll-receiving apparatus receiving a toll amount automatically based on communicated balance information received through a communication between a vehicle-carried unit which accepts a plurality of physically separate recording media, respective balance information being recorded on each of said plurality of physically separate recording media, and an on-road unit installed on a road, wherein one of said vehicle-carried unit and said on-road unit includes:

accumulating means for accumulating a total balance from said respective balance information recorded on each of said plurality of physically separate recording media after receiving said toll amount, and for recording new respective balance information on each of said plurality of physically separate recording media; and balance information output means for processing said total balance accumulated in said accumulating means and recording said processed total balance information on a new recording medium.

18. The automatic toll-receiving apparatus according to claim 17, wherein said vehicle-carried unit further comprise:

failure detecting means for detecting a failure of one of said plurality of physically separate recording media.

19. The automatic toll-receiving apparatus according to claim 18, further comprising:

warning means for giving a warning when a failure of said one recording medium is detected by said failure detecting means.

20. The automatic toll paying system according to claim 8, further comprising:

display means for displaying at least one of a payment amount obtained through communication with said on-road unit, said total balance before paying said toll charge, and a new total balance information after paying said toll charge.

21. The automatic toll-paying system according to claim 8, wherein:

said display means displays at least one of said respective balance information before paying said toll charge and a respective new balance information after paying said toll charge for each of said plurality of physically separate recording media.

22. The automatic toll-paying system according to claim 8, further comprising:

display-prohibiting means for prohibiting display of at least one of a payment amount obtained through communication with said on-road unit, said total balance before paying said toll charge, and a new total balance after paying said toll charge.

23. An automatic toll-paying system carried on a vehicle for automatically paying a toll charge through communication with an on-road unit installed on a road, said automatic toll-paying system comprising:

a plurality of accepting means, each of said plurality of accepting means accepting one of a plurality of physically separate recording media, respective balance information having been recorded on each of said physically separate recording media; and control means for reading a total balance information after paying said toll charge obtained through communication with said on-road unit and recording said total balance information on at least one of said plurality of physically separate recording media accepted by said plurality of accepting means.

24. An automatic toll-paying system according to claim 23, wherein:

said control means subtracts said respective balance information from said toll charge in an order starting from said respective balance information from one of said plurality of physically separate recording media having said respective balance information smaller than said respective balance information recorded on each remaining recording medium of said plurality of physically separate recording media, said control means records a respective new balance information onto said one of said plurality of physically separate recording media, said respective new balance information is 0 when said toll charge is not less than said respective balance information, said respective new balance information equals said toll charge subtracted from said respective balance information when said toll charge is less than said respective balance information.

25. An automatic toll-paying system according to claim 23, wherein said control means pays said toll charge by subtraction of a predetermined amount from each of said plurality of physically separate recording media.

26. An automatic toll-paying system according to claim 25, further comprising remainder-paying means for providing a driver with a means to indicate one of said plurality of physically separate recording media from which a remainder is subtracted when said remainder is generated, wherein said control means subtracts said predetermined amount and said remainder from said one of said plurality of recording media indicated by said remainder-paying means.

27. A method of automatically paying a toll charge through communication with an on-road unit installed on a road, said method comprising the steps of:

reading respective balance information from each of a plurality of physically separate recording media;

accumulating said respective balance information into a total balance; and transmitting said total balance to said on-road unit to automatically pay said toll charge.

28. A method of automatically paying a toll charge according to claim 27, further comprising the step of recording a respective new balance information on each of a plurality of said physically separate recording media.

* * * * *